US009408259B2

(12) United States Patent
Lethellier

(10) Patent No.: US 9,408,259 B2
(45) **Date of Patent: *Aug. 2, 2016**

(54) APPARATUS AND SYSTEM FOR PROVIDING POWER TO SOLID STATE LIGHTING

(71) Applicant: Point Somee Limited Liability Company, Dover, DE (US)

(72) Inventor: Patrice R. Lethellier, Sunnyvale, CA (US)

(73) Assignee: Chemtron Research LLC, Dover, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/293,975

(22) Filed: Jun. 2, 2014

(65) Prior Publication Data

US 2014/0265860 A1 Sep. 18, 2014

Related U.S. Application Data

(63) Continuation of application No. 13/572,499, filed on Aug. 10, 2012, now Pat. No. 8,742,679, which is a continuation of application No. 12/207,353, filed on Sep. 9, 2008, now Pat. No. 8,242,704.

(51) Int. Cl.

| | |
|---|---|
| ***H05B 39/00*** | (2006.01) |
| ***H05B 33/08*** | (2006.01) |
| ***H05B 37/02*** | (2006.01) |

(52) U.S. Cl.

CPC ..... *H05B 33/0806* (2013.01); *H05B 33/083* (2013.01); *H05B 33/0815* (2013.01); *H05B 37/0227* (2013.01)

(58) Field of Classification Search

CPC ..... H05B 33/08

USPC ..... 315/276–277, 279, 280, 290, 291, 294, 315/272, 200 R, 307

See application file for complete search history.

(56) References Cited

U.S. PATENT DOCUMENTS

| | | | |
|---|---|---|---|
| 6,104,146 | A | 8/2000 | Chou |
| 6,369,525 | B1 | 4/2002 | Chang |
| 6,829,151 | B2 | 12/2004 | Elferich |
| 6,888,529 | B2 | 5/2005 | Bruning |

(Continued)

FOREIGN PATENT DOCUMENTS

EP 1 320 284 A2 6/2003

OTHER PUBLICATIONS

European Search Report mailed Aug. 18, 2011, issued in European Application No. 09169401.8, filed Sep. 3, 2009, 6 pages.

*Primary Examiner* — Minh D A

(74) *Attorney, Agent, or Firm* — Christenson O'Connor Johnson Kindness PLLC

(57) ABSTRACT

An apparatus and computer readable storage medium are disclosed for supplying power to a load such as a plurality of light emitting diodes. A representative apparatus comprises a primary module, a first secondary module couplable to a first load, and a second secondary module couplable to a second load. The primary module comprises a transformer having a transformer primary. The first secondary module comprises a first transformer secondary magnetically coupled to the transformer primary, and the second secondary module comprises a second transformer secondary magnetically coupled to the transformer primary, with the second secondary module couplable through the first or second load to the first secondary module.

20 Claims, 12 Drawing Sheets

(56) References Cited

U.S. PATENT DOCUMENTS

| | | | | |
|---|---|---|---|---|
| 8,242,704 | B2 * | 8/2012 | Lethellier | H05B 33/0815 315/276 |
| 8,742,679 | B2 * | 6/2014 | Lethellier | H05B 33/0815 315/278 |
| 2005/0162858 | A1 | 7/2005 | Shiotsu | |
| 2006/0274024 | A1 * | 12/2006 | Wey et al. | 345/102 |
| 2007/0159421 | A1 | 7/2007 | Peker | |
| 2007/0262724 | A1 | 11/2007 | Mednik | |
| 2007/0262734 | A1 * | 11/2007 | Venkat et al. | 315/360 |
| 2007/0267984 | A1 * | 11/2007 | Peng | 315/312 |
| 2008/0088255 | A1 | 4/2008 | Wang | |

* cited by examiner

APPARATUS AND SYSTEM FOR PROVIDING POWER TO SOLID STATE LIGHTING

CROSS-REFERENCE TO RELATED APPLICATIONS

This application is a continuation of U.S. application Ser. No. 13/572,499, filed Aug. 10, 2012, which is a continuation of U.S. application Ser. No. 12/207,353, filed Sep. 9, 2008, now U.S. Pat. No. 8,242,704, the disclosure of which is incorporated by reference herein in its entirety.

BACKGROUND

Arrays of light emitting diodes are utilized for a wide variety of applications, including for ambient lighting and displays. For driving an array of LEDs, electronic circuits typically employ a power converter or LED driver to transform power from an AC or DC power source and provide a DC power source to the LEDs. When multiple LEDs are utilized, LED arrays may be divided into groups or channels of LEDs, with a group of LEDs connected in series typically referred to as a "string" or channel of LEDs.

Multichannel power converters are known, for example Subramanian Muthu, Frank J. P. Schuurmans, and Michael D. Pashly, "Red, Blue, and Green LED for White Light Illumination," *IEEE Journal on Selected Topics in Quantum Electronics,* 8(2):333-338, March/April 2002. Such prior art multistring LED drivers may utilize redundant power conversion modules, with a separate power module used for each LED string and typically comprising a driver, a transformer, a sensor, a controller, etc., for example. A similar approach is suggested in Chang et al., U.S. Pat. No. 6,369,525, entitled "White Light-Emitting-Diode Lamp Driver Based on Multiple Output Converter with Output Current Mode Control," which utilizes multiple redundant power conversion modules, with each power conversion module configured to provide power for a corresponding LED string. Providing redundant elements such as a redundant power module for each channel may increase the number of components and may increase the size and weight of the power converter. Such utilization of relatively many components may also increase costs, such as component costs and manufacturing costs, or reduce reliability. For prior art power converters utilizing redundant power modules, a fault in a power module, such as if one or more components in the power module fail, may result in the power module no longer providing power or providing power at a reduced level and may cause a corresponding channel of LEDs to lose power.

Another prior art method (Supertex data sheets LV 9120/9123 and Application Note AN-H13) arranges LED strings in series and utilizes a power converter to provide power to the series arrangement of LED strings. In such an arrangement, the voltage level across the series of strings may be substantially equal to the sum of each voltage level across each of the multiple strings, resulting in an accumulated, total voltage level across multiple strings that may reach significantly high levels. FIG. 1 is a voltage map illustrating such voltage levels at the output of a prior art power converter and across a plurality of LED strings, for an example configuration in which the power converter drives four LED strings coupled in series. The vertical axis represents voltage "V." Points along the horizontal axis represent corresponding points in the series configuration of LED strings. The first voltage level 20 for the "POWER CONVERTER OUTPUT," marks the voltage rise across the output of the prior art power converter from substantially zero volts at the negative output terminal of the power converter to a total voltage VT at the positive output terminal of the power converter. The second voltage level 21 for an LED "FIRST STRING" illustrates the voltage drop across the first string of LEDs, the third voltage level 22 for an LED "SECOND STRING" illustrates the voltage drop across the second string of LEDs, and so on. As illustrated, the voltage level drops substantially to zero (24) across the fourth string. If the voltage across each string is 50V, for example, the total voltage level VT across the four strings or across the prior art power converter output is substantially equal to the sum of the voltage levels across each string, or 200V. Such relatively high voltage levels may make such a series arrangement unsuitable for some applications, such as where people may possibly come in contact with power provided to LED arrays. Operating at relatively high voltage levels may also incur additional costs for an apparatus, such as costs for components adapted to operate with such high voltage levels and for additional insulation and other safety equipment, such as to protect people and property. This prior art approach of providing power to a series of LED strings also does not provide a means for a controller to independently control the brightness of each string or to independently turn individual strings on or off.

Other prior art power converters with multiple power modules for multiple LED strings typically couple each load (e.g., channel or string of LEDs) to one of a plurality of power modules in a parallel configuration, i.e., a first terminal of the load is coupled to a first terminal of the power module and a second terminal of the load is coupled to a second terminal of the same power module. With such an arrangement, if one or more components in the power module fail, the load may lose power. Also, such an arrangement, in which each power module is coupled in parallel to a load, typically utilizes redundant circuitry, such as multiple sensors and multiple controllers, to provide a desired current level to multiple loads.

Accordingly, a need remains for a multichannel power converter that provides power to a plurality of LEDs, such as multiple strings or channels of LEDs, at comparatively low overall voltage levels, and that provides an overall reduction in size, weight, and cost of the LED driver, such as by sharing components across channels. Such a converter may further provide selected or predetermined power levels to the LEDs and may also compensate for variations in circuit parameters such as manufacturing tolerances, input voltage, temperature, etc. The power converter should be fault tolerant. For example, in the event that one or more power modules or channels fail, the power converter should continue to provide power to operational channels. Also, it would be desirable to provide a power converter adapted for providing independently selected power levels for each LED channel and for independently turning LED channels on or off.

SUMMARY

The exemplary embodiments of the present disclosure provide numerous advantages for supplying power to loads such as LEDs. The various exemplary embodiments are capable of sustaining a plurality of types of control over such power delivery, such as providing a substantially constant or controlled current output to a plurality of groups or channels of LEDs. The exemplary embodiments may be provided which share power converter components across multiple channels, providing advantages such as relatively smaller size, less weight, lower cost, and higher reliability, compared to prior art power converters. The exemplary embodiments utilize a transformer with a plurality of secondary windings and a plurality of power modules, with each power module coupled to a group of LEDs in an alternating series arrangement, and shared regulation circuitry such as one or more common sensors, a common controller, a common transformer primary, etc. The exemplary embodiments may utilize bypass circuits to redirect current flow in the event that one or more channels or power modules become inoperative, such as during short circuit or open circuit conditions, with the bypass circuits enabling the power converter to provide power to remaining operational channels.

A first exemplary apparatus embodiment for power conversion, in accordance with the teachings of the present disclosure, is couplable to a power source, with the exemplary apparatus comprising: a primary module comprising a transformer having a transformer primary; a first secondary module couplable to a first load, with the first secondary module comprising a first transformer secondary magnetically coupled to the transformer primary; and a second secondary module couplable to a second load, with the second secondary module comprising a second transformer secondary magnetically coupled to the transformer primary, the second secondary module couplable in series through the first or second load to the first secondary module.

Typically, when energized by the power source, the first secondary module has a first voltage polarity and is couplable in a series with the first load configured to have an opposing, second voltage polarity. In an exemplary embodiment, a resultant voltage of the first voltage polarity combined with the second voltage polarity is substantially less than a magnitude of the first voltage polarity or the second voltage polarity. In another exemplary embodiment, the first voltage polarity and the second voltage polarity substantially offset each other to provide a comparatively low resultant voltage level.

Typically, when energized by the power source, the second secondary module has a third voltage polarity and is couplable in a series with the second load configured to have an opposing, fourth voltage polarity. In an exemplary embodiment, a resultant voltage of the combined first voltage polarity, the second voltage polarity, the third voltage polarity and the fourth voltage polarity is substantially less than a magnitude of the first voltage polarity, or the second voltage polarity, or the third voltage polarity, or the fourth voltage polarity. In another exemplary embodiment, the first voltage polarity, the second voltage polarity, the third voltage polarity, and the fourth voltage polarity substantially offset one another to provide a comparatively low resultant voltage level.

An exemplary apparatus may further comprise: a current sensor coupled to the first secondary module or the second secondary module and adapted to sense a current level; and a controller coupled to the current sensor and to the primary module, the controller adapted to regulate a transformer primary current in response to the sensed current level.

Another exemplary apparatus may further comprise: a first bypass circuit coupled to the first secondary module; and a second bypass circuit coupled to the second secondary module. An exemplary first bypass circuit is adapted to bypass the first secondary module and the first load in response to a detected fault, such as an open circuit.

In an exemplary embodiment, the first and second load each comprise at least one light emitting diode, and the controller is further adapted to provide dimming of light output by regulating the first bypass circuit or the second bypass circuit. For example, the controller may be further adapted to provide pulse width modulation to regulate the first bypass circuit or the second bypass circuit. Also for example, the controller may be further adapted to turn a corresponding switch into an on state or an off state to regulate the first bypass circuit or the second bypass circuit. Also for example, the first and second load each comprise at least one light emitting diode, and the controller may be further adapted to provide dimming of light output by regulating the transformer primary current.

In another exemplary embodiment, the first load comprises at least one first light emitting diode having a first emission spectrum (such as an emission spectrum in the red, green, blue, white, yellow, amber, or other visible wavelengths), and the second load comprises at least one second light emitting diode having a second emission spectrum. For example, a first LED may provide emission in the red visible spectrum, a second LED may provide emission in the green visible spectrum, and a third LED may provide emission in the blue visible spectrum. In such an exemplary embodiment, the controller may be further adapted to regulate an output spectrum by regulating the first bypass circuit, or the second bypass circuit, or a third bypass circuit, such as by dimming or bypassing a corresponding LED string, to modify the overall emitted light spectrum, such as to increase or decrease corresponding portions of red, green, or blue, for example.

In an exemplary embodiment, the controller may be electrically isolated from the primary module. For example, the controller may be coupled optically to the primary module.

In exemplary embodiments, the first secondary module and the second secondary module may be configured to have at least one of the following circuit topologies: a flyback configuration, a single-ended forward configuration, a half-bridge configuration, a full-bridge configuration, or a current doubler configuration.

Also in exemplary embodiments, the first secondary module may further comprise a first rectifier and a first filter, with the first rectifier coupled to the first transformer secondary, and the second secondary module may further comprise a second rectifier and a second filter, with the second rectifier coupled to the second transformer secondary.

An exemplary lighting system is also disclosed, with the system couplable to a power source, and with the system comprising: a primary module comprising a transformer having a transformer primary; a first light emitting diode; a second light emitting diode; a first secondary module coupled in series to the first light emitting diode, the first secondary module comprising a first transformer secondary magnetically coupled to the transformer primary; a second secondary module coupled in series to the second light emitting diode, the second secondary module comprising a second transformer secondary magnetically coupled to the transformer primary, the second secondary module coupled in series through the first or second light emitting diode to the first secondary module; a current sensor adapted to sense a current level; and a controller coupled to the current sensor and to the primary module, with the controller adapted to regulate a transformer primary current in response to the sensed current level.

Another exemplary apparatus for power conversion is also disclosed, with the apparatus couplable to a power source and to a plurality of light emitting diodes, and with the apparatus comprising: a primary module comprising a transformer having a transformer primary; a first secondary module couplable in series to a first light emitting diode of the plurality of light emitting diodes, the first secondary module comprising: a first transformer secondary magnetically coupled to the transformer primary, a first rectifier coupled to the first transformer secondary, and a first filter coupled to the first rectifier; a second secondary module couplable in series to a second light emitting diode of the plurality of light emitting diodes, the second secondary module couplable in series through the first or second light emitting diode to the first secondary module, the second secondary module comprising: a second transformer secondary magnetically coupled to the transformer primary, a second rectifier coupled to the second transformer secondary, and a second filter coupled to the second rectifier; a current sensor adapted to sense a current level; a controller coupled to the current sensor and to the primary module, the controller adapted to regulate a transformer primary current in response to the sensed current level; a first bypass circuit coupled to the first secondary module; and a second bypass circuit coupled to the second secondary module.

An exemplary method of providing power to a plurality of light emitting diodes is also disclosed. The exemplary method comprises: routing current from a first secondary module to a first light emitting diode coupled in series to the first secondary module to generate a first voltage across the first light emitting diode having an opposing polarity to a second voltage across the first secondary module; routing current from the first light emitting diode to a second secondary module coupled in series to the first light emitting diode; routing current from the second secondary module to a second light emitting diode coupled in series to the second secondary module to generate a third voltage across the second light emitting diode having an opposing polarity to a fourth voltage across the second secondary module; and routing current from the second light emitting diode to the first secondary module or to a third secondary module coupled in series to the second light emitting diode.

In an exemplary embodiment, the method further comprises: detecting a fault in the first secondary module or the first light emitting diode; and in response to the detected fault, providing a current bypass around the first secondary module and the first light emitting diode from a third light emitting diode to the second secondary module. The exemplary steps of detecting a fault and providing a current bypass may further comprise: sensing a first parameter; comparing the first parameter to a first threshold; and when the first parameter is greater than or substantially equal to the first threshold, switching current from the third light emitting diode to the second secondary module. For example, the detected fault may be a short circuit or an open circuit.

In another exemplary embodiment, the method further comprises: detecting a fault in the first secondary module or the first light emitting diode; and in response to the detected fault, interrupting the current from the first secondary module to the first light emitting diode. The exemplary steps of detecting a fault and interrupting the current may further comprise: sensing a second parameter; comparing the second parameter to a second threshold; and when the second parameter is greater than or substantially equal to the second threshold, creating an open circuit in the series path of the first secondary module and the first light emitting diode.

In another exemplary embodiment, the method further comprises: routing current from the first secondary module to the first light emitting diode for a first predetermined on-time duration at a first frequency; and routing current from the second secondary module to the second light emitting diode for a second predetermined on-time duration at a second frequency.

Numerous other advantages and features of the present disclosure will become readily apparent from the following detailed description of the disclosure and the embodiments thereof, from the claims and from the accompanying drawings.

DESCRIPTION OF THE DRAWINGS

The objects, features and advantages of the present disclosure will be more readily appreciated upon reference to the following when considered in conjunction with the accompanying drawings, wherein like reference numerals are used to identify identical components in the various views, and wherein reference numerals with alphabetic characters are utilized to identify additional types, instantiations or variations of a selected component embodiment in the various views, in which.

DETAILED DESCRIPTION

Figure 1:
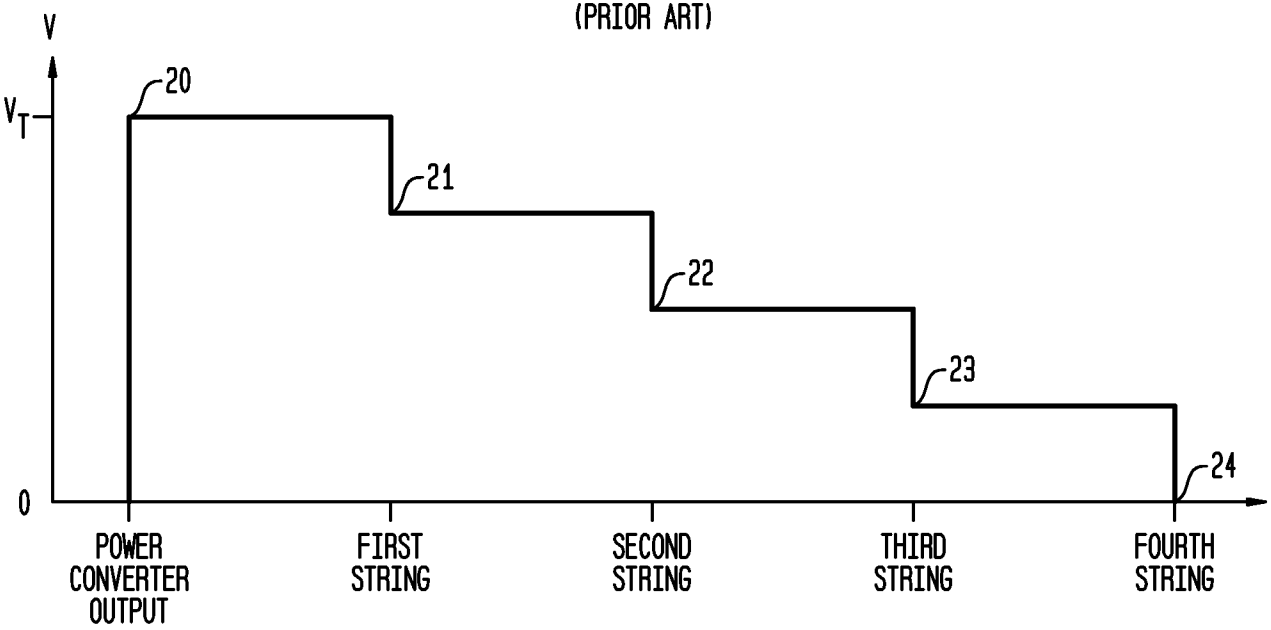
FIG. 1 (PRIOR ART)
FIG. 1 is a graphical diagram illustrating a voltage map of voltage levels at the output of a prior art power converter and across corresponding loads.

While the present disclosure illustrates embodiments in many different forms, there are shown in the drawings and will be described herein in detail specific exemplary embodiments thereof, with the understanding that the present disclosure is to be considered as an exemplification of the principles of the claimed subject matter and is not intended to limit the claimed subject matter to the specific embodiments illustrated. In this respect, before explaining at least one embodiment consistent with the present invention in detail, it is to be understood that the invention is not limited in its application to the details of construction and to the arrangements of components set forth above and below, illustrated in the drawings, or as described in the examples. Methods and apparatuses consistent with the present invention are capable of other embodiments and of being practiced and carried out in various ways. Also, it is to be understood that the phraseology and terminology employed herein, as well as the abstract included below, are for the purposes of description and should not be regarded as limiting.

Figure 2:
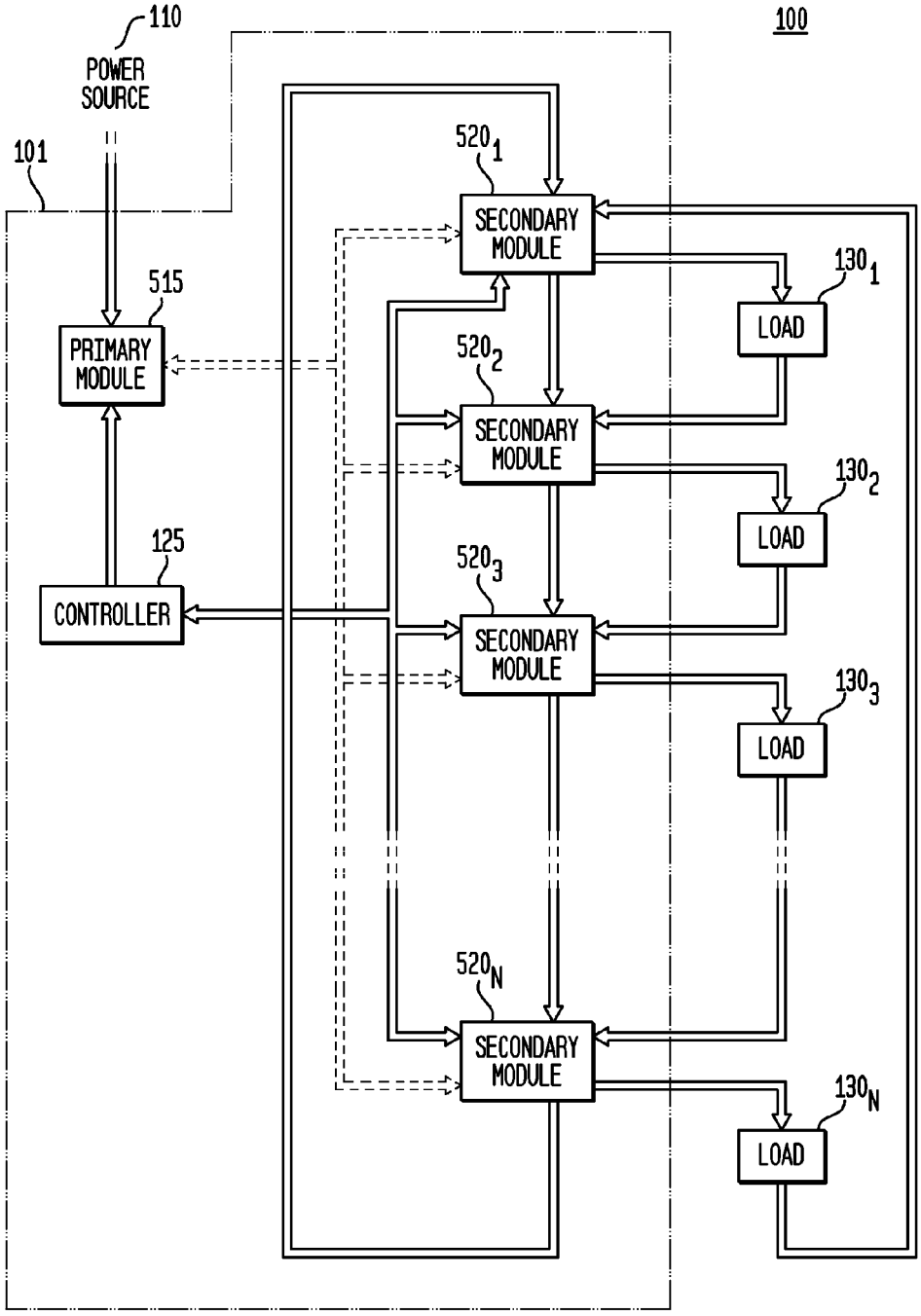
FIG. 2 is a block diagram illustrating a first exemplary system and a first exemplary apparatus in accordance with the teachings of the present disclosure.

FIG. 2 is a block diagram illustrating a first exemplary system 100 and a first exemplary apparatus 101 in accordance with the teachings of the present disclosure. The system 100 comprises the apparatus 101 and a plurality of loads $\mathbf{130}_1$, $\mathbf{130}_2$, $\mathbf{130}_3$, through $\mathbf{130}_N$, and is couplable to receive input power, such as an AC or DC input voltage, from power source 110. (AC and DC input voltages as referred to herein and within the scope of the present disclosure are discussed in greater detail below.) The apparatus 101 comprises a primary module (or primary power module) 515, a controller 125, and a plurality of "N" secondary modules $\mathbf{520}_1$, $\mathbf{520}_2$, $\mathbf{520}_3$, through $\mathbf{520}_N$, which may be referred to collectively herein as secondary modules 520. Primary module 515 is coupled to secondary modules 520 magnetically, with the magnetic coupling illustrated as dashed lines. The primary module 515 comprises at least one transformer primary, and each secondary module 520 comprises a corresponding transformer secondary magnetically coupled to the transformer primary, such as by being wound on a common magnetic core or otherwise in magnetic or close proximity. In exemplary embodiments, as described in greater detail below, a secondary module may comprise a power module (having the transformer secondary) and, as an option, a bypass circuit. As illustrated, loads 130 comprise a plurality of "N" individual loads $\mathbf{130}_1$, $\mathbf{130}_2$, through $\mathbf{130}_N$.

Primary module 515 is couplable to power source 110 and provides power to secondary modules 520. Power source 110 may provide, for example, AC, DC, chopped DC, or another form of power. In an exemplary embodiment, primary module 515 provides power in the form of magnetic energy via a transformer primary (also referred to as a primary winding) and each secondary module 520 receives the magnetic energy via a corresponding transformer secondary (also referred to as a secondary winding). Primary module 515 may comprise, for example and without limitation, an AC-to-DC converter, such as a rectifier, and a switch adapted to conduct or otherwise apply power in the form of a current or voltage to a transformer primary. The power applied to the transformer primary may comprise a power signal such as a sine wave, a square or rectangular wave, a series of pulses, etc. The power signal may vary, such as in terms of amplitude and/or wave shape, in response to a control signal from controller 125. Those having skill in the electronic arts will recognize that numerous techniques are available for providing power to a transformer primary, and that primary module 515 may have innumerable implementations and configurations, any and all of which are considered equivalent and within the scope of the present disclosure.

In an exemplary embodiment, a first terminal of a first load $\mathbf{130}_1$ is coupled to a first secondary module $\mathbf{520}_1$ and a second terminal of first load $\mathbf{130}_1$ is coupled to a second secondary module $\mathbf{520}_2$. A first terminal of a second load $\mathbf{130}_2$ is coupled to second secondary module $\mathbf{520}_2$ and a second terminal of second load $\mathbf{130}_2$ is coupled to a third secondary module $\mathbf{520}_3$. Other loads 130 and secondary modules 520 are similarly coupled (i.e., each load is coupled to two (electrically adjacent) secondary modules) up through load $\mathbf{130}_N$, where a first terminal of an $N^{th}$ load $\mathbf{130}_N$ is coupled to an $N^{th}$ secondary module $\mathbf{520}_N$ and a second terminal of $N^{th}$ load $\mathbf{130}_N$ is coupled to first secondary module $\mathbf{520}_1$. Such an arrangement places secondary modules 520 and loads 130 in series, with a load between each pair of adjacent secondary modules 520. Such an arrangement may be referred to herein as an "alternating series" arrangement in two ways, with a secondary module 520 alternating with a load 130 in series, and as discussed below, with corresponding voltages across a secondary module 520 and a load 130 alternating in polarities. (The term "adjacent" may refer to sequential components in a series circuit. For example, secondary module $\mathbf{520}_N$ may be considered to be adjacent to secondary module $\mathbf{520}_{N-1}$ and secondary module $\mathbf{520}_1$.) In an exemplary embodiment, secondary modules 520 and loads 130 are coupled in series so that current flows through a secondary module 520 and a load 130, then another secondary module 520 and a load 130, and so on, in a complete circuit.

In an exemplary embodiment, the secondary modules 520 and loads 130 are arranged such that each output voltage level provided by a secondary module 520 is substantially compensated by a corresponding voltage drop across a corresponding load 130. For example, a voltage rise with a first voltage polarity, such as a positive voltage across first secondary module $\mathbf{520}_1$ which provides power to first load $\mathbf{130}_1$ is substantially offset by a corresponding voltage drop across the first load $\mathbf{130}_1$ having a second, opposing voltage polarity, such as a negative voltage. A similar pattern holds for other secondary modules 520 and loads 130, wherein the voltage rises across each secondary module and then drops across each corresponding load, providing a resultant, overall voltage that is substantially less than the magnitude of the voltage rise or the voltage drop, and may even be relatively or substantially close to zero (depending upon whether the opposing voltage polarities are closely matched). As a result, overall voltage levels at the terminals of loads 130 remain within predetermined and comparatively lower limits. This novel feature of the present disclosure is discussed below in greater detail with reference to FIG. 5.

Controller 125 may be adapted to sense one or more parameters from one or more secondary modules 520 or loads 130. Sensed parameters, for example, may comprise a current level or a voltage level, such as a current level through or voltage level of one or more loads 130 or secondary modules 520. The sensed current or voltage level may be utilized by controller 125 and primary module 515 to directly or indirectly regulate current through loads 130, such as to provide substantially stable current levels or current levels at or near selected or predetermined values. For example, in response to a sensed parameter, the controller 125 may increase or decrease the current through the transformer primary of the primary module 515, and/or may separately modify current or voltage provided by a secondary module 520, such as by using the bypass circuitry discussed below (not separately illustrated in FIG. 2).

For example, and among other things, the controller 125 utilizes one or more sensed parameters, as feedback signals, to output a control signal to primary module 515, such as to regulate power levels to loads 130. The control signal may be utilized by primary module 515 to determine a power level to be provided to secondary modules 520. In an exemplary embodiment, the controller 125 may utilize a sensed parameter to cause primary module 515 to reduce the level of power or current provided to secondary modules 520 if current to loads 130 exceeds a first predetermined threshold or to increase the level of power or current provided to secondary modules 520 if current to loads 130 falls below a second predetermined threshold.

Controller 125 may also be adapted to supply control signals to secondary modules 520 to independently adjust power or current levels to loads $\mathbf{130}_1$, $\mathbf{130}_2$, $\mathbf{130}_3$, through $\mathbf{130}_N$, such as for dimming or turning on or off one or more channels. In an exemplary embodiment, a temperature sensor (not separately illustrated in FIG. 2), is adapted to determine a parameter in response to a temperature such as LED temperature, and provides feedback to controller 125 for thermal regulation, such as adjusting output power levels in response to one or more sensed temperature values. For example, controller 125 may be configured to reduce the power level to loads 130 if a sensed temperature value rises above a predetermined level. Other forms of control of power levels provided to an individual secondary module 520 and/or a load 130 is discussed in greater detail below.

Secondary modules 520 may be configured to bypass or shunt current past one or more loads 130 in the event of one or more faults, such as short circuits or open circuits in one or more secondary modules 520 or loads 130. As illustrated in FIG. 2, secondary modules 520 are each coupled to two adjacent secondary modules 520, thereby providing a path for such current bypass. For example, in the event of a detected fault in load $\mathbf{130}_1$, secondary module $\mathbf{520}_1$ may redirect current to secondary module $\mathbf{520}_2$ that would otherwise be provided to load $\mathbf{130}_1$.

Controller 125 may comprise analog circuitry such as amplifiers, comparators, integrators, etc. and/or digital circuitry such as processors, memory, gates, A/D and D/A converters, etc. Those having skill in the electronic arts will recognize that numerous techniques are known for regulating power to one or more loads and that controller 125 may have innumerable implementations and configurations, any and all of which are considered equivalent and within the scope of the present disclosure.

Figure 3:
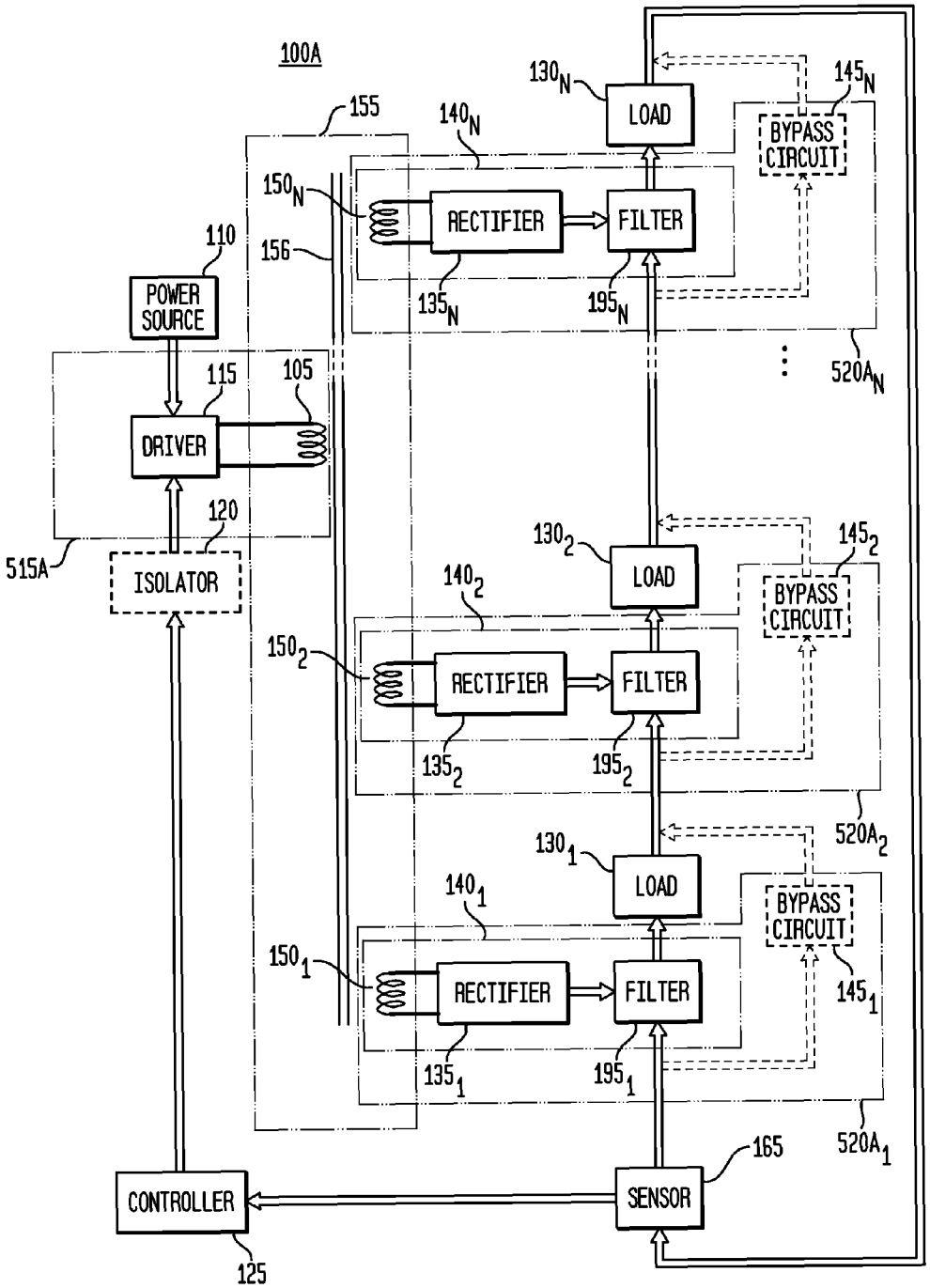
FIG. 3 is a block diagram illustrating a second exemplary system and second exemplary apparatus in accordance with the teachings of the present disclosure.

FIG. 3 is a block diagram illustrating a second exemplary system 100A and second exemplary apparatus in accordance with the teachings of the present disclosure. The system 100A is couplable to a power source 110 and the system 100A comprises a primary module 515A (as an example of a primary module 515), a plurality of secondary (power) modules 520A (as examples of secondary modules 520), a controller 125, a sensor 165, an optional isolator 120, and loads 130. The apparatus (also couplable to a power source 110) is illustrated generally and may be considered to comprise the primary module 515A, the plurality of secondary modules 520A, the controller 125, the sensor 165, and optionally the isolator 120. In this exemplary embodiment, the primary module 515A comprises a driver (circuit) 115 and a transformer primary 105 (of transformer 155). In this exemplary embodiment, each secondary module 520A comprises a corresponding power module 140 and, as an option, a corresponding bypass circuit 145. Each power module 140 comprises a transformer secondary 150 (of transformer 155) and other circuitry, such as a rectifier 135 and a filter 195. The optional isolator 120 also may be considered to be contained within the primary module 515A.

Stated another way, the system 100A comprises a driver 115, a controller 125, a transformer 155, a sensor 165, a plurality of secondary power modules $\mathbf{140}_1$, $\mathbf{140}_2$, through $\mathbf{140}_N$, and a plurality of loads $\mathbf{130}_1$, $\mathbf{130}_2$, through $\mathbf{130}_N$. In exemplary embodiments, the system 100A may further comprise a plurality of bypass circuits $\mathbf{145}_1$, $\mathbf{145}_2$, through $\mathbf{145}_N$. In exemplary embodiments, system 100A may further comprise an isolator 120 configured to, for example, electrically isolate the driver 115 from the controller 125. (AC and DC input voltages as referred to herein and within the scope of the present disclosure are discussed in greater detail below). In an exemplary embodiment, each power module $\mathbf{140}_1$, $\mathbf{140}_2$, through $\mathbf{140}_N$ comprises a corresponding transformer secondary ($\mathbf{150}_1$, $\mathbf{150}_2$, through $\mathbf{150}_N$), a corresponding rectifier ($\mathbf{135}_1$, $\mathbf{135}_2$, through $\mathbf{135}_N$), and a corresponding filter ($\mathbf{195}_1$, $\mathbf{195}_2$, through $\mathbf{195}_N$), respectively. In an alternative exemplary embodiment, filters 195 may be omitted or combined with rectifiers 135.

As illustrated, loads 130 comprise a plurality of "N" individual loads $\mathbf{130}_1$, $\mathbf{130}_2$, through $\mathbf{130}_N$. Components with a plurality of instantiations may be referenced herein collectively without subscripts or individually with subscripts. For example, loads 130 may be referred to equivalently as loads $\mathbf{130}_1$, $\mathbf{130}_2$, through $\mathbf{130}_N$. Similar notation applies to power modules 140, secondaries 150, rectifiers 135, filters 195, bypass circuits 145, etc.

In FIG. 3, transformer 155 is illustrated with a split secondary configuration and comprises a transformer primary 105 and a plurality of transformer secondaries $\mathbf{150}_1$, $\mathbf{150}_2$, through $\mathbf{150}_N$. Primary 105 is magnetically coupled to secondaries $\mathbf{150}_1$, $\mathbf{150}_2$, through $\mathbf{150}_N$, such as through a transformer core 156. Transformer 155 may be configured, using any of various methods known in the electronic arts, for example and without limitation as a forward transformer, a flyback transformer, a flyback or forward transformer with active reset, etc. Those having skill in the electronic arts will recognize that alternate transformer configurations may be utilized. For example transformer 155 may also be implemented with a plurality of primaries or as a plurality of transformers, such as with primaries coupled in parallel.

As illustrated, a power source 110 provides AC or DC power to driver 115. As mentioned above, such AC or DC power may be, for example, single phase or multiphase AC, DC or chopped DC power, such as from batteries or from an AC to DC converter, or any other form of electrical power. Driver 115 receives power from power source 110, converts received power to DC if appropriate, receives control signals from controller 125 (optionally via isolator 120), and provides a driving signal to primary 105. Driver 115 may, for example, provide a PWM (pulse width modulated) signal, and may use any of various modes of operation such as continuous conduction mode (CCM), discontinuous conduction mode (DCM), and critical conduction mode. Driver 115 may comprise one or more stages such as power conversion stages. Those having skill in the electronic arts will recognize that there are numerous methods for utilizing a controller 125 and a driver 115 for providing driving signals, any and all of which are considered equivalent and within the scope of the present disclosure.

Transformer secondaries $\mathbf{150}_1$, $\mathbf{150}_2$, through $\mathbf{150}_N$ are coupled to and provide power to rectifiers $\mathbf{135}_1$, $\mathbf{135}_2$, through $\mathbf{135}_N$, respectively. In an exemplary embodiment, rectifiers $\mathbf{135}_1$, $\mathbf{135}_2$, through $\mathbf{135}_N$ convert AC power from secondaries $\mathbf{150}_1$, $\mathbf{150}_2$, through $\mathbf{150}_N$, respectively, into DC power. Filters $\mathbf{195}_1$, $\mathbf{195}_2$, through $\mathbf{195}_N$ smooth the DC power from rectifiers $\mathbf{135}_1$, $\mathbf{135}_2$, through $\mathbf{135}_N$, respectively, to provide a relatively or comparatively stable DC power level.

In the exemplary embodiment as illustrated in FIG. 3, the power modules $\mathbf{140}_1$, $\mathbf{140}_2$, through $\mathbf{140}_N$ and loads $\mathbf{130}_1$, $\mathbf{130}_2$, through $\mathbf{130}_N$ are provided in an "alternating series" configuration, wherein the loads 130 and power modules 140 are in series, with loads 130 alternatingly interspersed between power modules 140. As illustrated, loads 130 and power modules 140 form a ring-like arrangement, with current passing alternately through loads 130 and power modules 140 in a complete circuit.

In an exemplary embodiment, a first terminal of a first load $\mathbf{130}_1$ is coupled to a second terminal of a first power module $\mathbf{140}_1$ and a second terminal of the first load $\mathbf{130}_1$ is coupled to a first terminal of a second power module $\mathbf{140}_2$. Other cells may be coupled similarly, i.e., a first terminal of "$K^{th}$" load $\mathbf{130}_K$, $1 \leq K < N$, is coupled to a second terminal of $K^{th}$ power module $140_K$ and a second terminal of $K^{th}$ load $130_K$ is coupled to a first terminal of a $K+1^{th}$ power module $140_{K+1}$. In an exemplary embodiment, a first terminal of $N^{th}$ load $130_N$ is coupled to a second terminal of $N^{th}$ power module $140_N$ and a second terminal of $N^{th}$ load $130_N$ is coupled to a first terminal of sensor 165. A second terminal of sensor 165 is coupled to a first terminal of first power module $140_1$. In an alternative embodiment (not illustrated in FIG. 3), the first terminal of $N^{th}$ load $130_N$ is coupled to the second terminal of Nth power module $140_N$ and the second terminal of $N^{th}$ load $130_N$ is coupled to the first terminal of first power module $140_1$.

In an exemplary embodiment, a sensor 165 determines a sensed parameter such as a current level. Controller 125 receives the sensed parameter information or signal from sensor 165 and utilizes the sensed parameter information to provide one or more control signals (such as a series of control signals) for driver 115.

While FIG. 3 and other Figures herein illustrate embodiments with exemplary sensor locations, those having skill in the electronic arts will recognize that there are innumerable other sensor locations, implementations and configurations, any and all of which are considered equivalent and within the scope of the present disclosure. For example, sensor 165 may be placed in series with any of loads 130 or power modules 140. As another example, one or more sensors may be incorporated into one or more loads 130, power modules 140, or bypass circuits 145. Sensors may comprise various types of sensing components such as optical sensors, temperature sensors, voltage sensors, current sensors, etc. For example, sensor 165 may comprise one or more optical components adapted to utilize LED brightness to determine one or more sensed parameters.

FIG. 3 and other Figures herein illustrate exemplary arrangements wherein loads 130 and power modules are coupled in alternating series in a ring-like arrangement to form a complete circuit; however, it is to be understood that loads 130 and power modules 140 may be arranged in innumerable configurations, including without limitation arrangements comprising a plurality of rings, arrangements wherein a plurality of power modules 140 are coupled between loads 130, arrangements wherein a plurality of loads 130 are coupled between power modules 140, etc., any and all of which are considered equivalent and within the scope of the present invention.

In an exemplary embodiment, bypass circuits 145 provide a switchable current (or voltage) path around loads 130 and power modules 140. Bypass circuits 145 may be utilized to provide current flow in the event of detected faults or to provide a means for reducing or increasing current flow through individual loads 130, such as for light dimming and for turning individual loads 130 on or off. Bypass circuits 145 are described in further detail below.

In an exemplary embodiment, current levels in power modules 140 and loads 130 may be substantially the same (since they are coupled in series), so current sensing and corresponding control may be accomplished with fewer components, compared to prior art multichannel LED drivers where power to individual channels is separately regulated for each channel. More particularly, in the exemplary embodiment illustrated in FIG. 3, current provided to multiple loads 130 may be regulated by shared components such as sensor 165, controller 125, isolator 120, driver 115, and transformer 155, which may be shared across a plurality of channels. Compared to prior art multichannel LED drivers in which current to each load is regulated by a separate and redundant set of components such as redundant sensors, controllers, isolators, and drivers, exemplary embodiments of the present invention may provide numerous advantages such as fewer components, lower component and manufacturing costs, reduced size and weight, and higher reliability.

In an exemplary embodiment, as mentioned above, the power modules 140 (of the secondary modules 520) and loads 130 are arranged such that each output voltage level provided by a power module 140 (of a corresponding secondary module 520) is substantially compensated by a corresponding voltage drop across a corresponding load 130. For example, a voltage rise with a first voltage polarity, such as a positive voltage across first power module $140_1$ which provides power to first load $130_1$, is substantially offset by a corresponding voltage drop across the first load $130_1$ having a second, opposing voltage polarity, such as a negative voltage. A similar pattern holds for other power modules 140 and loads 130, wherein the voltage rises across each power module 140 and then drops across each corresponding load, providing a resultant, overall voltage that is substantially less than the magnitude of the voltage rise or the voltage drop, and may even be relatively or substantially close to zero (depending upon whether the opposing voltage polarities are closely matched). As a result, overall voltage levels at the terminals of loads 130 remain within predetermined and comparatively lower limits, as described above.

Figure 4:
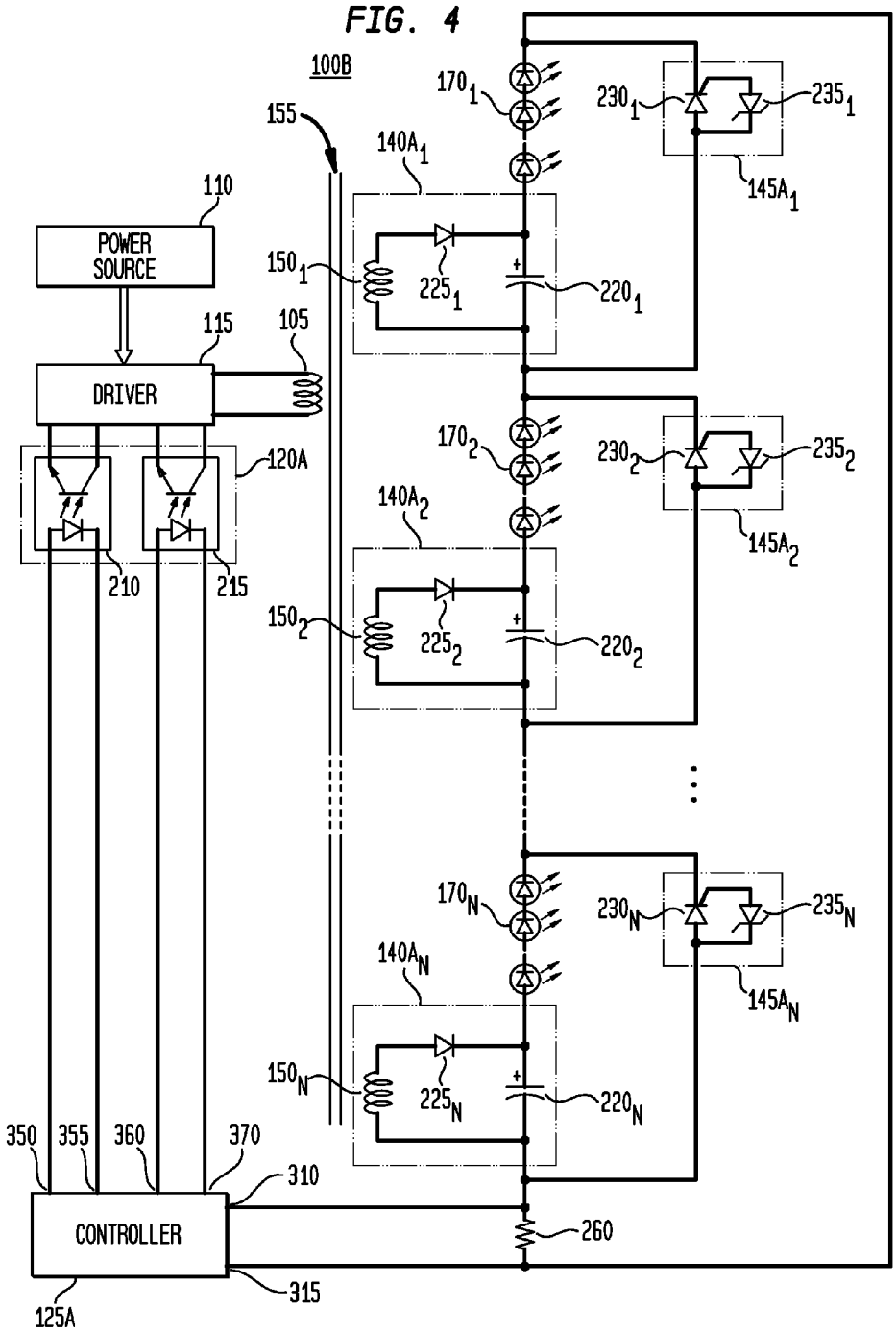
FIG. 4 is a block diagram illustrating a third exemplary system and third exemplary apparatus in accordance with the teachings of the present disclosure.

FIG. 4 is a block diagram illustrating a third exemplary system 100B and third exemplary apparatus in accordance with the teachings of the present invention. For ease of reference and visual clarity, the apparatus, primary module and secondary module divisions of the system 100B are not separately demarcated or otherwise separately illustrated in FIG. 4. The system 100B also is couplable to receive input power, such as an AC or DC input voltage, from power source 110, and the system 100B comprises a plurality of loads, illustrated as LEDs 170, a driver 115, an optional isolator 120A, a controller 125A, a plurality of power modules $140A_1$, $140A_2$, through $140A_N$, a plurality of bypass circuits $145A_1$, $145A_2$, through $145A_N$, a transformer 155, and a sensor 260. (An apparatus portion of system 100B is not separately illustrated, but may be considered to comprise driver 115, optional isolator 120A, controller 125A, sensor 260, power modules 140A, transformer 155, and bypass circuits 145A. In this exemplary embodiment, a primary module is not separately illustrated, but may be considered to comprise driver 115 and transformer primary 105 (of transformer 155). Also in this exemplary embodiment, a secondary module is not separately illustrated, but may be considered to comprise a corresponding power module 140A and, as an option, a corresponding bypass circuit 145A. Each power module 140A comprises a transformer secondary 150 (of transformer 155) and other circuitry as illustrated. The optional isolator 120A also may be considered to be contained within the primary module.) FIG. 4 provides an example of the power modules 140A (of a corresponding secondary module) and transformer primary 105 (of a primary module) having a flyback configuration.

Each power module ($140A_1$, $140A_2$, through $140A_N$) comprises a corresponding transformer secondary ($150_1$, $150_2$, through $150_N$), a corresponding diode ($225_1$, $225_2$, through $225_N$), and a corresponding capacitor ($220_1$, $220_2$, through $220_N$), respectively. Each bypass circuit ($145A_1$, $145A_2$, through $145A_N$) comprises a switch, illustrated as a silicon controlled rectifier (SCR) ($230_1$, $230_2$, through $230_N$) and a voltage sensor, illustrated as a zener diode ($235_1$, $235_2$, through $235_N$), respectively. Transformer 155 comprises primary 105 and a plurality of secondaries $150_1$, $150_2$, through $150_N$. Isolator 120A comprises a first optical isolator 210 and a second optical isolator 215. One skilled in the electronic arts will recognize that isolator 120A, illustrated in FIG. 4 and elsewhere herein, may be, in various exemplary embodiments, omitted or implemented using any of numerous methods, such as utilizing various types of isolators such as optical isolators, transformers, differential amplifiers, etc., any and all of which are considered equivalent and within the scope of the present invention.

In FIG. 4 and elsewhere herein, the exemplary configuration of LEDs as strings is illustrative. As discussed in greater detail below, other arrangements are possible, any and all of which are considered equivalent and within the scope of the present invention, In the following discussion, operation of power modules 140A will be described using power module 140$A_1$ as an example. Operation of power modules 140$A_2$ through 140$A_N$ is similar. As illustrated, power module 140$A_1$ comprises a transformer secondary 150$_1$, a diode 225$_1$, and a capacitor 220$_1$. The secondary 150$_1$ provides power to diode 225$_1$. Diode 225$_1$ acts as a half-wave rectifier to provide DC power to a DC smoothing filter, illustrated as capacitor 220$_1$. In FIG. 4 and elsewhere herein, capacitors may be polarized or non-polarized. The secondary 150$_1$ charges capacitor 220$_1$ through diode 225$_1$. Capacitor 225$_1$ and secondary 150$_1$ (via diode 225$_1$) provide DC power to LED string 170$_1$.

As with FIG. 3, power modules 140A and LED strings 170 may be coupled in alternating series, with a first terminal of each LED string 170$_K$, $1 \leq K < N$, coupled to a second terminal of power module 140$A_K$ and a second terminal of each LED string 170$_K$ coupled to a first terminal of a second power module 140$A_{K+1}$. The first terminal of LED string 170$_N$ is coupled to a second terminal of power module 140$A_N$ and a second terminal of LED string 170$_N$ is coupled through a first sensor, illustrated as resistor 260, to a first terminal of power module 140$A_1$.

As illustrated in FIG. 4, power modules 140A and LEDs 170 are arranged as alternating in series in a ring-like arrangement so that current flows alternately through a power module 140A and LEDs 170. Current flowing out of power module 140A1 flows in sequential order through LEDs 170$_1$, power module 140$A_2$, LEDs 170$_2$, etc., then through power module 140$A_N$, LEDs 170$_N$, resistor 260, and back to power module 140$A_1$. This novel current path allows overall, resulting voltage levels to remain relatively low compared to prior art systems. In particular, a voltage rise across a given power module 140$A_K$ is substantially matched by a corresponding voltage drop across a corresponding LED string 170$_K$, as illustrated in FIG. 5.

More particularly, in an exemplary embodiment, as mentioned above, the power modules 140A and LEDs 170 (as loads 130) are arranged such that each output voltage level provided by a power module 140A (of a corresponding secondary module) is substantially compensated by a corresponding voltage drop across corresponding LEDs 170. For example, a voltage rise with a first voltage polarity, such as a positive voltage across first power module 140$A_1$ which provides power to first LEDs 170$_1$, is substantially offset by a corresponding voltage drop across the first LEDs 170$_1$ having a second, opposing voltage polarity, such as a negative voltage. A similar pattern holds for other power modules 140A and LEDs 170, wherein the voltage rises across each power module 140A and then drops across each corresponding string of LEDs 170, providing a resultant, overall voltage that is substantially less than the magnitude of the voltage rise or the voltage drop, and may even be relatively or substantially close to zero (depending upon whether the opposing voltage polarities are closely matched). As a result, overall voltage levels at the terminals of LEDs 170 remain within predetermined and comparatively lower limits, as described above.

Figure 5:
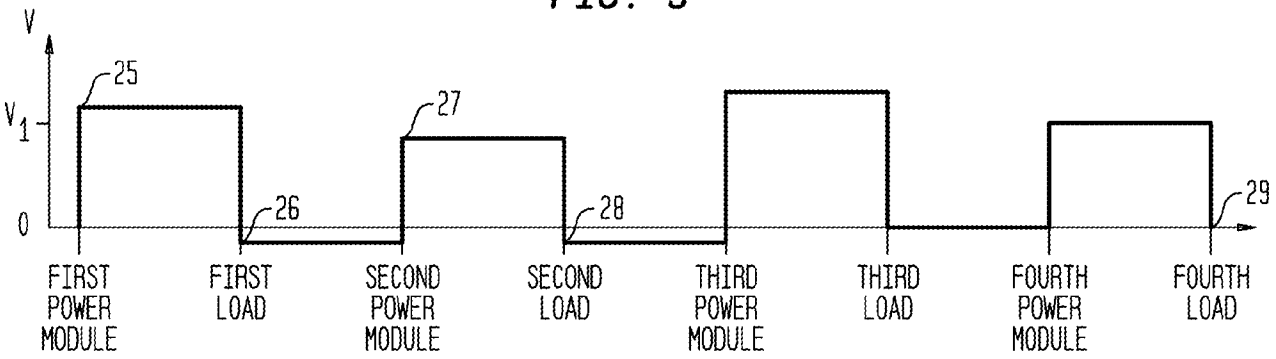
FIG. 5 is a graphical diagram illustrating a voltage map of voltage levels across power modules and LEDs in accordance with the teachings of the present disclosure.

FIG. 5 is a graphical diagram illustrating a voltage map of voltage levels across power modules 140A and LEDs 170 in accordance with the teachings of the present invention. The voltage map illustrates voltage levels for an example configuration wherein four power modules 140$A_1$, 140$A_2$, 140$A_3$, and 140$A_4$ drive four LED strings 170$_1$, 170$_2$, 170$_3$, and 170$_4$. The vertical axis represents voltage levels. Points along the horizontal axis represent corresponding points in the circuit topology. The first voltage level 25 for "FIRST POWER MODULE" illustrates the voltage rise with a first voltage polarity across the first power module 140$A_1$ from substantially zero volts at a first terminal of first power module 140$A_1$ to a voltage level of approximately (or slightly greater than) $V_1$ at a second terminal of the first power module 140$A_1$. The second voltage level 26 for a "FIRST LOAD" illustrates the voltage drop with a second, opposing voltage polarity across a first and second terminal of the first LED string 170$_1$ to a level relatively near zero. Accordingly, the voltage rise across first power module 140$A_1$ is substantially offset by the voltage drop across first LED string 1701$_1$ so that the overall or resultant voltage (of the voltage rise (or first voltage polarity) combined with the voltage drop (or second voltage polarity)) is substantially less than a magnitude of the first voltage polarity or the second voltage polarity, and as illustrated, is substantially close to zero volts.

In the example illustrated in FIG. 5, the voltage across first LED string 170$_1$ drops to a level slightly below zero, a situation that may occur, for example, if there is a difference between the voltage rise and the voltage drop. The voltage drop across LEDs 170 may substantially match the corresponding voltage rise across power modules 140, though there may be some difference between the voltage rise and the voltage drop due to factors such as variations in characteristics of power modules 140A and LEDs 170. In practice, the voltage across each load may drop to a level slightly above or slightly below zero. Such differences may arise as a result of numerous factors such as manufacturing tolerances, temperature, device aging, engineering approximations, variability of the power source 110, etc. It should be understood that the voltage maps shown in FIG. 1, FIG. 5, and FIG. 6 (described later) are exemplary and approximate, that the illustrations herein represent an idealized example for purposes of explication and should not be regarded as limiting, and that actual measurements in practice may and likely will deviate from these representations.

The third voltage level 27 for "SECOND POWER MODULE" shows the voltage rise (i.e., a third voltage polarity) across second power module 140$A_2$. The fourth voltage level 28 for "SECOND LOAD" shows the subsequent voltage drop (i.e., a fourth voltage polarity) across the second LED string 170$_2$ to a level relatively near zero. Such a pattern of voltage rising across power modules 140A and falling by approximately the same amount across LEDs 170 continues through to the fourth load, where the voltage level falls across the fourth load to a value relatively near zero (29). In other words, the voltage rise across power modules 140A may be approximately proportional to the voltage drop across LED strings 170, with the voltage level returning to a value relatively near or about zero volts after each voltage drop. The voltage map of FIG. 5 illustrates how an exemplary embodiment with an alternating series configuration may provide power conversion where the maximum voltage level is approximately that of a voltage level across a single LED string 170$_K$, $1 \leq K \leq N$. Compared to a prior art power converter such as a system with a voltage map as illustrated in FIG. 1, or where the maximum voltage may be substantially equal to the sum of voltage levels across multiple strings, exemplary embodiments of the current invention may operate with relatively lower voltage levels. In addition, with relatively lower voltage levels, expenses such as costs for components adapted to operate with relatively high voltage levels and for additional insulation and other safety equipment may be reduced or substantially eliminated.

Referring again to FIG. 4, bypass circuits 145A provide switchable current paths around power modules 140A and LEDs 170. In an exemplary embodiment, bypass circuits 145A may provide one or more alternate current (or voltage) paths in the event of a fault, such as a short circuit or an open circuit condition. Such a fault may occur, for example, in one or more of power modules 140A or LEDs 170. In an alternative embodiment, bypass circuits 145A provide for reducing or increasing power levels to one or more of LED strings 170, for example to selectively reduce or increase brightness levels, or to change or modify the overall emitted spectrum, as mentioned above.

The operation of bypass circuits 145A in an exemplary embodiment is described utilizing an example of a first bypass circuit 145$A_1$, a first power module 140$A_1$, and a first LED string 170$_1$. Operation of bypass circuits 145$A_2$ through 145$A_N$ is similar. Transformer 155 provides power to diode 225$_1$ via secondary 150$_1$. Diode 225$_1$ is configured as a half-wave rectifier and converts power from secondary 150$_1$ to DC power. Capacitor 220$_1$ acts as a filter to smooth the DC power and provide a relatively constant DC power level. As illustrated in FIG. 4 and elsewhere herein, the first power module 140$A_1$ comprises a DC smoothing filter, illustrated as capacitor 220$_1$; however, in various embodiments, power modules 140A may be configured with or without DC smoothing filters. Since the voltage rise across power module 140$A_1$ may be substantially offset by the voltage drop across LED string 170$_1$, the voltage across bypass circuit 145$A_1$, absent faults, may be close to zero.

An exemplary embodiment of the present invention provides continued operation for one or more channels in the event of any of several fault modes. An example of a first fault mode is where an LED string becomes substantially nonconducting. In an exemplary embodiment, if LED string 170$_1$ becomes a relatively high impedance or open circuit (i.e. enters a state where it is substantially nonconducting), such as due to a failed LED or a broken connection, the voltage level across bypass circuit 145$A_1$ may increase. The voltage level increase may be caused by current from other power modules 140$A_2$, 140$A_3$, etc., providing power to a relatively high impedance circuit comprising LED string 170$_1$. When the voltage level across bypass circuit 145$A_1$ reaches or exceeds a predetermined level, such as a threshold voltage, bypass circuit 145$A_1$ detects a fault. (Other examples of detecting faults by comparing parameter values to thresholds are described below.) After the voltage level across bypass circuit 145$A_1$ reaches or exceeds a predetermined level (such as a predetermined level determined, in part, by a threshold (or breakdown) voltage of zener diode 235$_1$), zener diode 235$_1$ conducts current into the gate of SCR 230$_1$ and causes SCR 230$_1$ to switch on (i.e. switch to a conducting state). With SCR 230$_1$ switched on, SCR 230$_1$ shunts current past power module 140$A_1$ and LED string 170$_1$ to other power modules 140A and LEDs 170. By thus shunting current around the open circuit (as an example of a detected fault), bypass circuit 145$A_1$ provides an alternate path for current to flow to power modules 140$A_2$ through 140$A_N$ and LEDs 170$_1$ through 170$_2$ in the event of an open circuit (or high impedance) condition in power module 140$A_1$ or LED string 170$_1$. Likewise, bypass circuits 145$A_2$ through 145$A_N$ provide alternate current paths in the event of open circuit conditions in power modules 140$A_1$ through 140$A_N$ or LED strings 170$_1$ through 170$_N$, respectively.

Figure 6:
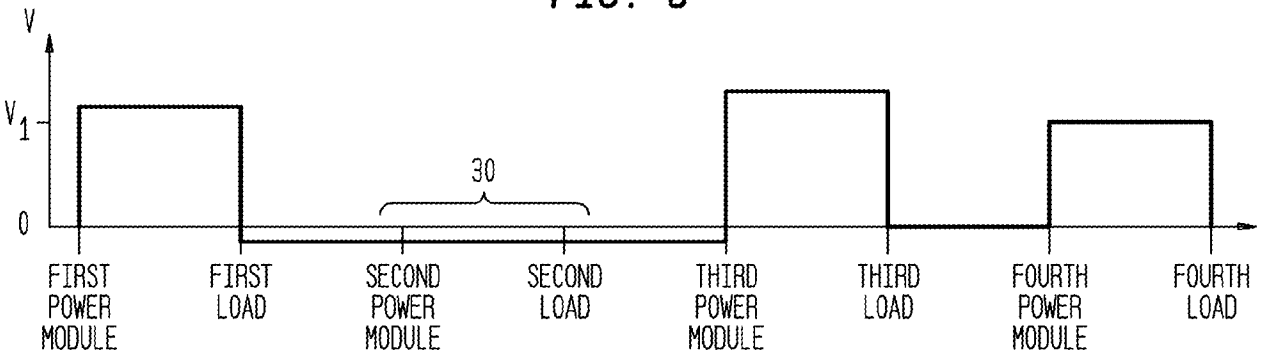
FIG. 6 is a graphical diagram illustrating a voltage map of voltage levels during a bypass of a component fault in accordance with the teachings of the present disclosure.

FIG. 6 is a graphical diagram illustrating a voltage map of voltage levels during a component fault in accordance with the teachings of the present invention. FIG. 6 illustrates how voltage levels may change from those illustrated in FIG. 5 in the event of a fault, such as an open circuit in the second power module or the second load as illustrated. During a fault condition, such as a second fault mode where second power module 140$A_2$ stops providing power and becomes an open circuit, a second bypass circuit 145$A_2$ may shunt current around power module 140$A_2$ and LED string 170$_2$. With second power module 140$A_2$ providing substantially no power, the voltage rise across second power module 140$A_2$ may be substantially zero. With substantially no current flowing through the second load LED string 170$_2$ (due to the fault in power module 140$A_2$ and current shunted by second bypass circuit 145$A_2$), the voltage drop across the second load may be substantially zero. The voltage rise and drop of substantially zero are illustrated in FIG. 6 and appear as a substantially flat voltage level 30 from the point labeled "SECOND POWER MODULE" to the point labeled "SECOND LOAD." As described and illustrated in the example of FIG. 6, a fault in the second power module 140$A_2$ may affect the associated load, LED string 170$_2$, but the second bypass circuit 145$A_2$ provides an alternate current path so that operational channels such as the first load, third load, and fourth load may receive power.

Returning to FIG. 4, zener diode 230$_1$ effectively operates as and may be considered to be a sensor, since it senses and responds to a parameter such as voltage across power module 140$A_1$ and LED string 170$_1$. Operation of first bypass circuit 145$A_1$ may be described as a method of sensing a parameter such as a voltage level, comparing the sensed parameter to a threshold such as the first zener diode 230$_1$ breakdown voltage level, and, when the sensed parameter is greater than the threshold, redirecting current from LED string 170$_N$ (via resistor 260) around first power module 140$A_1$ and first LED string 170$_1$ to a second power module 140$A_2$ and LED string 170$_2$.

Figure 7:
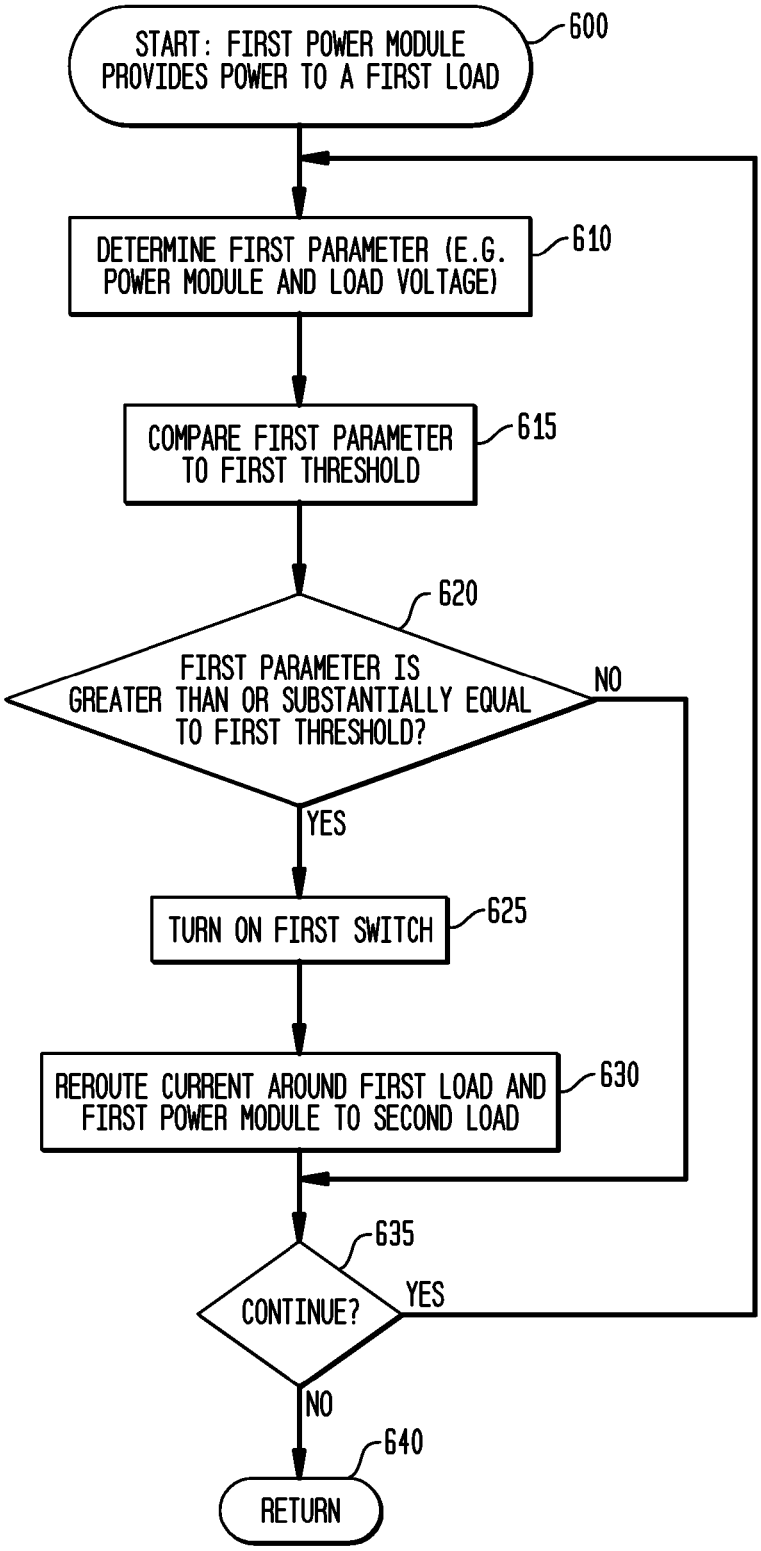
FIG. 7 is a flow diagram illustrating a first exemplary method of bypassing a component fault in accordance with the teachings of the present disclosure.

FIG. 7 is a flow diagram illustrating a first exemplary method of bypassing a component fault in accordance with the teachings of the present invention. For ease of explanation, the circuit topology of FIG. 4 will be utilized in the following discussion of FIG. 7, with the understanding that the derived bypass methodology of the exemplary embodiments is applicable to numerous bypass topologies, including (without limitation) those illustrated in FIG. 3, FIG. 4, FIG. 8, FIG. 10, FIG. 12, and FIG. 13, and is not limited to those specifically illustrated herein. The method illustrated in FIG. 7 may utilize, as an example, a first power module 140$A_1$, a first load, illustrated in FIG. 4 as LED string 170$_1$, a first bypass circuit 145$A_1$, and a second load, illustrated as LED string 170$_2$.

Beginning with start step 600, a first power module 140$A_1$ provides power to a first load, implemented as LED string 170$_1$. In step 610, a bypass circuit 145$A_1$ determines a first sensed parameter, such as a voltage level across the first power module 140$A_1$ and the first load, LED string 170$_1$. Typically, the first sensed parameter will be measured continuously or periodically (e.g., sampled), for ongoing use in a plurality of comparison steps. In step 615, the first sensed parameter is compared to a first threshold such as a first predetermined value substantially proportional to the breakdown voltage of the zener diode 235$_1$, plus the gate voltage of SCR 230$_1$ (the voltage applied to the gate that turns on SCR $230_1$). In step 620, when the value of the first sensed parameter is greater than or substantially equal to the first threshold, the method proceeds to step 625 and bypasses the detected fault (illustrated in two steps), where the first switch, SCR $230_1$ is turned on (step 625), for example by zener diode $235_1$ then to step 630, where due to the conducting SCR $230_1$, the bypass circuit $145A_1$ reroutes current around the first power module $140A_1$ and the first load, LED string $170_1$ and provides current to the second load, LED string $170_2$. In one embodiment of the present invention, the first switch may remain in an on state until power is removed from power modules 140A. As other faults may occur, following step 630, when the method is to continue (i.e., as long as input power is available to the converter), step 635, the method returns to step 610 for ongoing monitoring, and otherwise may end, return step 640. When the value of the first sensed parameter is not greater than or substantially equal to the first threshold in step 620, and also when the method is to continue in step 635, the method also returns to step 610.

Referring again to FIG. 4, an example of a second fault mode is where power module $140A_1$ stops providing power and becomes an open or relatively high impedance circuit. In an exemplary embodiment, this second fault mode results in a sequence of events similar to those of the first fault mode and as described above and illustrated in FIG. 7, i.e. voltage increases across bypass circuit $145A_1$, zener diode $235_1$ trips, triggering SCR $230_1$, and SCR $230_1$ shunts power around power module $140A_1$ and LED string $170_1$.

An example of a third fault mode is where LED string $170_1$ substantially becomes a short circuit (i.e. is set to a relatively low impedance state). In an exemplary embodiment, if LED string $170_1$ substantially becomes a short circuit, LED string $170_1$ continues to conduct current, thus providing a path for current to flow to other channels. Power module $140A_1$ may continue to provide power, which may be utilized by other LED channels.

An example of a fourth fault mode is where power module $140A_1$ becomes a short circuit (i.e. enters a relatively low impedance state), such as if power module $140A_1$ stops providing power or provides power at a reduced level, yet continues to conduct current. In an exemplary embodiment, current may continue to flow through power module $140A_1$ and LED string $170_1$. If the breakdown voltage of zener diode $235_1$ is set to a relatively high voltage level, such as a value greater than the operational forward voltage across LED string $170_1$, then zener diode $235_1$ and SCR $230_1$ may remain in a nonconducting state and LED string $170_1$ may continue to receive power. At least some of the power provided to LED string $170_1$ during this fourth fault mode may be provided by one or more of power modules $140A_2$ through $140A_N$. In such an exemplary embodiment, LED string $170_1$ may remain lit while its corresponding power module $140A_1$ fails, which is a significant improvement, compared to prior art where an LED channel may lose power if its corresponding power converter fails. In an alternative exemplary embodiment, the breakdown voltage of zener diode $235_1$ is set to a relatively low voltage level, such as significantly less than the operational forward voltage across LED string $170_1$. In this alternative exemplary embodiment, in the fourth fault mode, zener diode $235_1$ trips, triggering SCR $230_1$, which shunts current around power module $140A_1$ and LED string $170_1$.

As described above, in the event of a fault in a representative power module $140A_1$ or LED string $170_1$, under the fault modes described herein, other LED strings (i.e., LED strings $170_2$, $170_3$, through $170_N$) may continue to receive power. This desirable feature, described herein with respect to power module $140A_1$, LED string $170_1$, and bypass circuit $145A_1$, as an example, may apply also to other LED strings $170_2$ through $170_N$ and their corresponding bypass circuits $145A_2$ through $145A_N$ and power modules $140A_2$ through $140A_N$, respectively. A fault in circuitry associated with one or more channels may tend to increase or decrease power levels in other channels. Controller 125A may compensate for such a power level change, such as by utilizing a sensed parameter from resistor 260 and adjusting a power output level from driver 115 to primary 105 to bring levels of power provided to LED strings 170 closer to selected or predetermined values using feedback and control methods known in the electronic arts.

Continuing with FIG. 4, resistor 260 acts as a current sensor, placed in series with power modules 140A and LED strings 170 and provides a sensed parameter value to controller 125A via a first input 310 and a second input 315. Controller 125A utilizes the sensed parameter value to provide a control signal, such as via a first output 350, a second output 355, and a first optical isolator 210 to driver 115 for maintaining current levels through LED 170 within a predetermined range.

A third output 360 and a fourth output 370 of controller 125A may be utilized to provide an over-voltage signal via optical isolator 215 to driver 115. An over-voltage condition may comprise, for example, a state where a voltage level across one or more components, such as LED strings 170 or power modules 140A, rises above a predetermined level. This predetermined level may, for example, correspond to a voltage level deemed to be unsafe or correspond to a condition where LEDs 170 may no longer be receiving useful amounts of power, in which case it may be desirable to discontinue providing power to power modules 140A. Such an over-voltage condition may cause current through resistor 260 to decrease, so voltage across resistor 260 may be utilized in determining an over-voltage condition. In an exemplary embodiment, the value of a sensed parameter such as LED current may be determined utilizing resistor 260 and compared to a predetermined threshold by controller 125A. If the value of the sensed parameter is less than the predetermined threshold, controller 125A may output an over-voltage signal (optionally via optical isolator 215) to driver 155, causing driver 115 to discontinue providing power to primary 105.

In the exemplary embodiment illustrated in FIG. 4 and elsewhere herein, it may be desirable to protect LEDs 170 from power surges at startup and to provide a "soft start," where power to LEDs 170 may be increased at a controlled rate, when power is first applied. In an exemplary embodiment, controller 125A provides a "soft start" at power-up. For example, when power source 110 first provides power to driver 115, controller 125A may provide a set of control signals to driver 115, wherein the control signals may be adapted to cause power to LEDs 170 to increase gradually to operational levels and to maintain output power levels below predetermined levels such as maximum rated power for LEDs 170. Other controllers (such as controllers 125, 125A, 125B, 125C, and 125D) described and illustrated herein may also be adapted to provide a soft start. Those having skill in the electronic arts will recognize that numerous methods are known for generating control signals to provide a soft start, any and all of which are considered equivalent and within the scope of the present invention.

Figure 8:
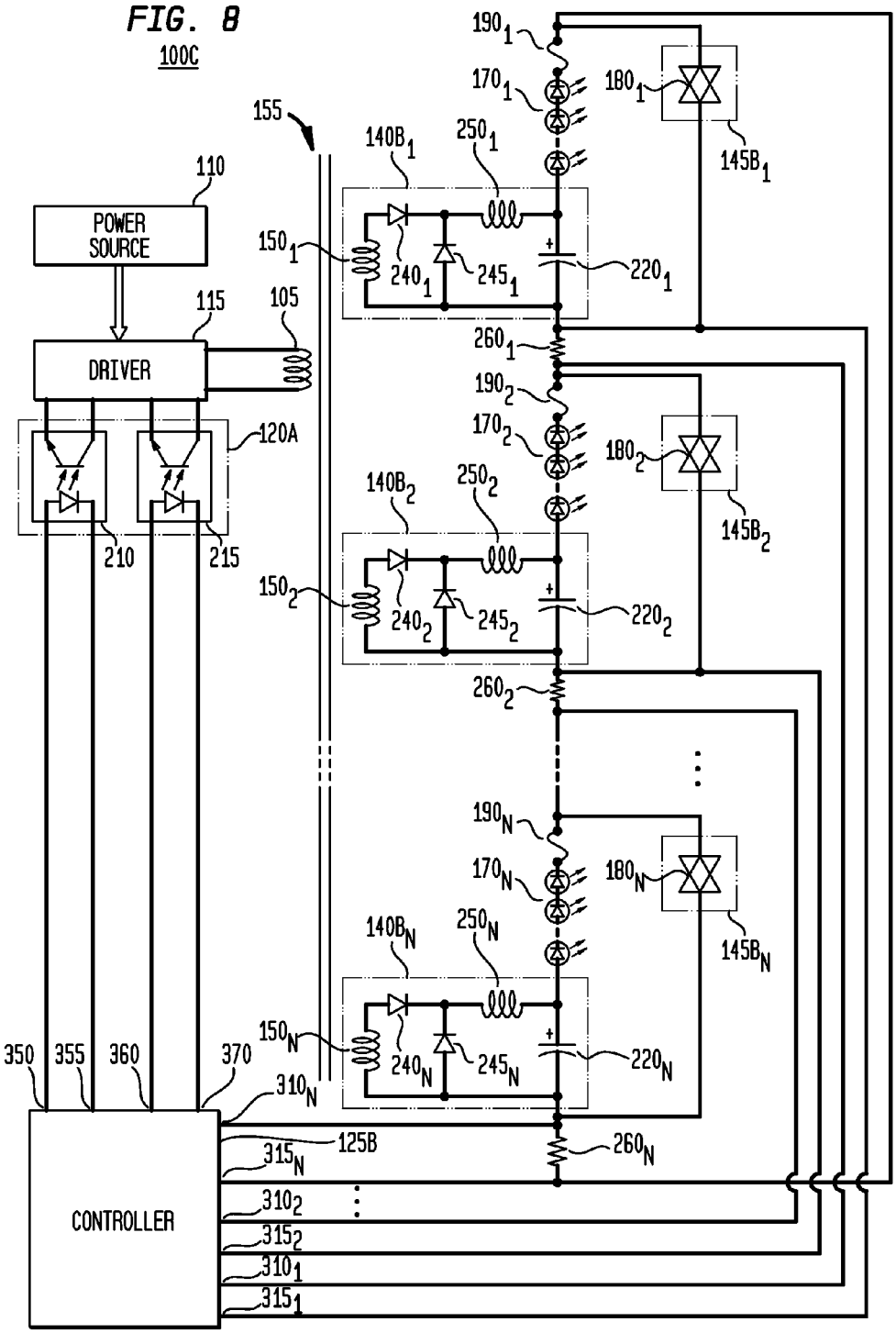
FIG. 8 is a block and circuit diagram illustrating a fourth exemplary system and fourth exemplary apparatus in accordance with the teachings of the present disclosure.

FIG. 8 is a block and circuit diagram illustrating a fourth exemplary system 100C and fourth exemplary apparatus in accordance with the teachings of the present invention. As illustrated, the fourth exemplary system 100C differs from the respective third exemplary system 100B insofar as system 100C utilizes multiple sensors, comprising resistors 260, buck-based rectifiers for DC power conversion, diacs 180 for bypass, and fuses 190 for current protection, and otherwise functions similarly as described above for system 100B. Each power module (140$B_1$, 140$B_2$, through 140$B_N$) comprises a corresponding first diode (240$_1$, 240$_2$, through 240$_N$), a corresponding second diode (245$_1$, 245$_2$, through 245$_N$), and a corresponding inductor (250$_1$, 250$_2$, through 250$_N$), respectively. Controller 125B is configured with one or more inputs, illustrated as inputs 310$_1$, 310$_2$, through 310$_N$ and 315$_1$, 315$_2$, through 315$_N$. An apparatus portion of system 100C is not separately illustrated, but may be considered to comprise driver 115, isolator 120A, controller 125B, resistors 260, power modules 140B, transformer 155, and bypass circuits 145B. In this exemplary embodiment, a primary module is not separately illustrated, but may be considered to comprise driver 115 and transformer primary 105 (of transformer 155). Also in this exemplary embodiment, a secondary module is not separately illustrated, but may be considered to comprise a corresponding power module 140B and, as an option, a corresponding bypass circuit 145B. Each power module 140B comprises a transformer secondary 150 (of transformer 155) and other circuitry as illustrated. The optional isolator 120A also may be considered to be contained within the primary module. FIG. 8 provides an example of the power modules 140B (of a corresponding secondary module) and transformer primary 105 (of a primary module) having a single-ended forward configuration.

Fuses 190 may be any of a wide variety of devices known to limit current or provide current protection, as known or becomes known to those having skill in the electronic arts, such as resettable fuses, non-resettable fuses, resistors, voltage dependent resistors such as varistors or metal oxide varistors, circuit breakers, thermal breakers such as bimetallic strips and other thermostats, thermistors, positive temperature coefficient (PTC) thermistors, polymeric positive temperature coefficient devices (PPTCs), switches, sensors, active current limiting circuitry, etc. Depending upon the selected embodiment, with the diacs 180 considered first switches, the fuses 190 may function as and be considered second "switches" in accordance with the present invention.

Operation of power modules 140B, fuses 190, resistors 260, and bypass circuits 145B will be described herein utilizing power module 140$B_1$, fuse 190$_1$, resistor 260$_1$, and bypass circuits 145$B_1$ as examples. Operation of power modules 140$B_2$ through 140$B_N$, fuses 190$_2$ through 190$_N$, and bypass circuits 145$B_2$ through 145$_N$ is similar. Power module 140$B_1$ comprises a transformer secondary 150$_1$, a first diode 240$_1$, a second diode 245$_1$, an inductor 250$_1$, and a capacitor 220$_1$. The transformer secondary 150$_1$ provides power through first diode 240$_1$ to inductor 250$_1$. First diode 240$_1$, second diode 245$_1$, and inductor 250$_1$ form a buck-based rectifier to convert power from secondary 150$_1$ to DC. Inductor 250$_1$ and a DC smoothing filter, illustrated as capacitor 220$_1$, provide power to LED string 170$_1$. As illustrated, bypass circuit 145$B_1$ differs from the respective exemplary bypass circuit 145$A_1$ in FIG. 4 insofar as bypass circuit 145$B_1$ is implemented utilizing a diac 180$_1$. In alternative embodiments (not separately illustrated), the diac 180$_1$ may be replaced with another switch such as a thyristor (e.g., a Sidac). Diac 180$_1$ senses a parameter such as a voltage level across bypass circuit 145$B_1$. If the sensed parameter value is greater than a predetermined threshold, the diac trips, i.e., enters a closed or "on" or conducting state, and shunts current past fuse 190$_1$, LED string 170$_1$, and power module 140$B_1$.

In an exemplary embodiment, operation of the topology illustrated in FIG. 8 under various fault modes is similar to that described above with reference to FIG. 4. In an alternative embodiment illustrated in FIG. 9 (below), operation of the embodiment illustrated in FIG. 8 differs from that of FIG. 4 insofar as fuses 190 may be utilized to interrupt current during one or more short circuits in LED strings 170 or when current levels through any of LED strings 170 are greater than a predetermined threshold.

Controller 125B functions similarly to controller 125A, as described above, but is able to utilize additional signals from the additional sensors 260 to provide more fine-tuned control over the driver 115. Feedback signals from any of the sensors 260 may be utilized, for example, to control the voltage or current levels of the driver 115 (and/or transformer primary 105) and/or to control various switches (e.g., as illustrated separately in FIG. 10).

Figure 9:
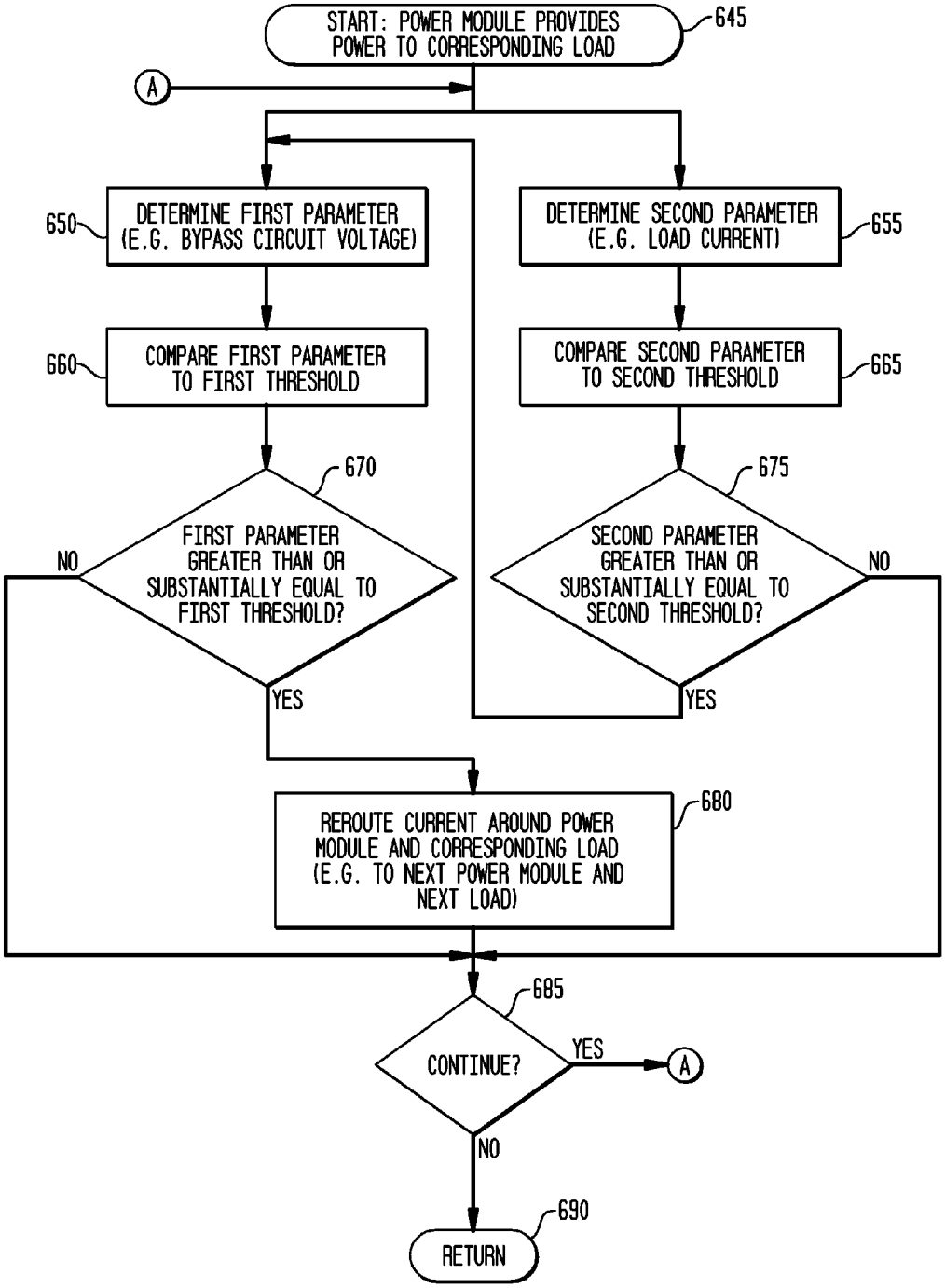
FIG. 9 is a flow diagram illustrating a second exemplary method of bypassing a component fault in accordance with the teachings of the present disclosure.

FIG. 9 is a flow diagram illustrating a second exemplary method of bypassing a component fault in accordance with the teachings of the present invention. In the discussion below, FIG. 8 is utilized as a reference, however it is to be understood that the exemplary method illustrated in FIG. 9 is applicable to numerous topologies, including without limitation those illustrated in the Figures herein. Beginning with start step 645, a power module (140$B_1$) provides power to a corresponding first load, implemented as LED string 170$_1$. Depending upon the type of switching utilized, initially at start up, a first switch (such as an SCR 230$_1$ or a diac 180$_1$), may be set to an off state, and a second switch, such as a fuse 190$_1$, may be set to an on state (such as when a fuse is closed or in a conducting state). In step 650, a first parameter is determined, such as a voltage level across the bypass circuit 145$B_1$ or other circuit parameter, such as by the bypass circuit 145$B_1$ (comprising a first switch, such as an SCR 230$_1$ or a diac 180$_1$, and a first sensor, such as a zener diode 235$_1$ or the diac 180$_1$). In step 655, a second parameter is determined, such as current through the first corresponding load, LED string 170$_1$, typically by a fuse 190$_1$, functioning as both a second switch and a sensor. Typically, the first and second parameters will be measured continuously or periodically (e.g., sampled), for ongoing use in a plurality of comparison steps.

In step 660, the magnitude of the first parameter (e.g., (1) the voltage level across bypass circuit 145$B_1$ or (2) the voltage level across first power module 140$B_1$, fuse 190$_1$, and the first load, LED string 170$_1$) is compared to a first threshold, such as the diac 180$_1$ trip voltage. (The comparison in step 660 is a magnitude comparison, comparing the magnitude of the first parameter with the magnitude of the first threshold, since the polarities of the first parameter and the first threshold may be reversed.) If LED string 170$_1$ becomes an open circuit or enters a relatively or substantially high impedance state, the voltage rise across power module 140$B_1$ may be substantially greater than the (otherwise offsetting) voltage drop across LED string 170$_1$, and the voltage level across bypass circuit 145$B_1$ may be greater than or substantially equal to a first threshold, such as a diac 180$_1$ trip voltage level. Similarly, if LED string 170$_1$ becomes a short circuit or enters a relatively or substantially low impedance state, such that it no longer provides an offsetting voltage, the voltage rise across power module 140$B_1$ may be substantially greater than the (otherwise offsetting) voltage drop across LED string 170$_1$, and the voltage level across bypass circuit 145$B_1$ may be greater than or substantially equal to a first threshold, such as a diac 180$_1$ trip voltage level. Accordingly, in step 670, when the value of the first parameter is greater than or substantially equal to the first threshold, the method proceeds to step 680 and bypasses or reroutes current around the power module and corresponding load, e.g., reroutes current to a next power module and a next load. In exemplary embodiments, step 680 is accomplished by turning on a first switch (i.e., setting the first switch to a conducting state), such as SCR 230$_1$ or diac 180$_1$. In addition, in exemplary embodiments, the second switch (e.g., fuse 190, or other type of second switch) may be open circuited or otherwise rendered substantially non-conducting. When the value of the first parameter is not greater than or substantially equal to the first threshold, the method proceeds to step 685.

It should be noted that, in the embodiments illustrated in FIG. 8 and FIG. 9 and elsewhere herein, the breakdown voltage or trip voltage of bypass circuits 145B (and variations 145, 145A, etc.) may be symmetrical or asymmetrical. For example, the bypass circuits may be configured to trigger at a first voltage threshold in a positive direction and at a second voltage threshold in a negative direction.

Similarly, in step 665, the magnitude of the second parameter is compared to a second threshold, such as the rated current or break point of fuse 190$_1$. If LED string 170$_1$ becomes a short circuit or enters a relatively low impedance state (as with the third fault mode described above), power module 140B$_1$ may provide a relatively high level of current through fuse 190$_1$ that is greater than the second threshold. In step 675, when the magnitude (or value) of the second parameter is greater than or substantially equal to a second threshold, such a fuse 190$_1$ or other similar device will become non-conducting or otherwise turn off, creating an open circuit, which will have the ultimate effect of bypassing or rerouting current around the power module and corresponding load, e.g., reroutes current to a next power module and a next load, step 680 (via steps 650, 660, 670 and 680 discussed above). More particularly, if the portion of the circuit having the LED string 170$_1$ becomes an open circuit via a non-conducting fuse 190$_1$ or enters a relatively or substantially high impedance state, the voltage rise across power module 140B$_1$ may be substantially greater than the (otherwise off-setting) voltage drop across LED string 170$_1$, and the voltage level across bypass circuit 145B$_1$ may be greater than or substantially equal to a first threshold, such as a diac 180$_1$ trip voltage level, which will reroute current as previously discussed. In an exemplary embodiment (not shown in FIG. 9), depending on how the first switch (e.g., SCR 230$_1$ or a diac 180$_1$) is implemented, if fuse 190$_1$ is resettable, it may close after the rerouting of step 680. When the value of the second parameter is not greater than or substantially equal to the second threshold in step 675, the method proceeds to step 685. In an exemplary embodiment of the present invention, the first switch may remain in an on state until power is removed from the power module 140B$_1$. Following steps 670, 675 or 680, when the method is to continue, e.g., until power is removed from power module 140B$_1$, the method returns to steps 650 and 655, and otherwise may end, return step 690.

Figure 10:
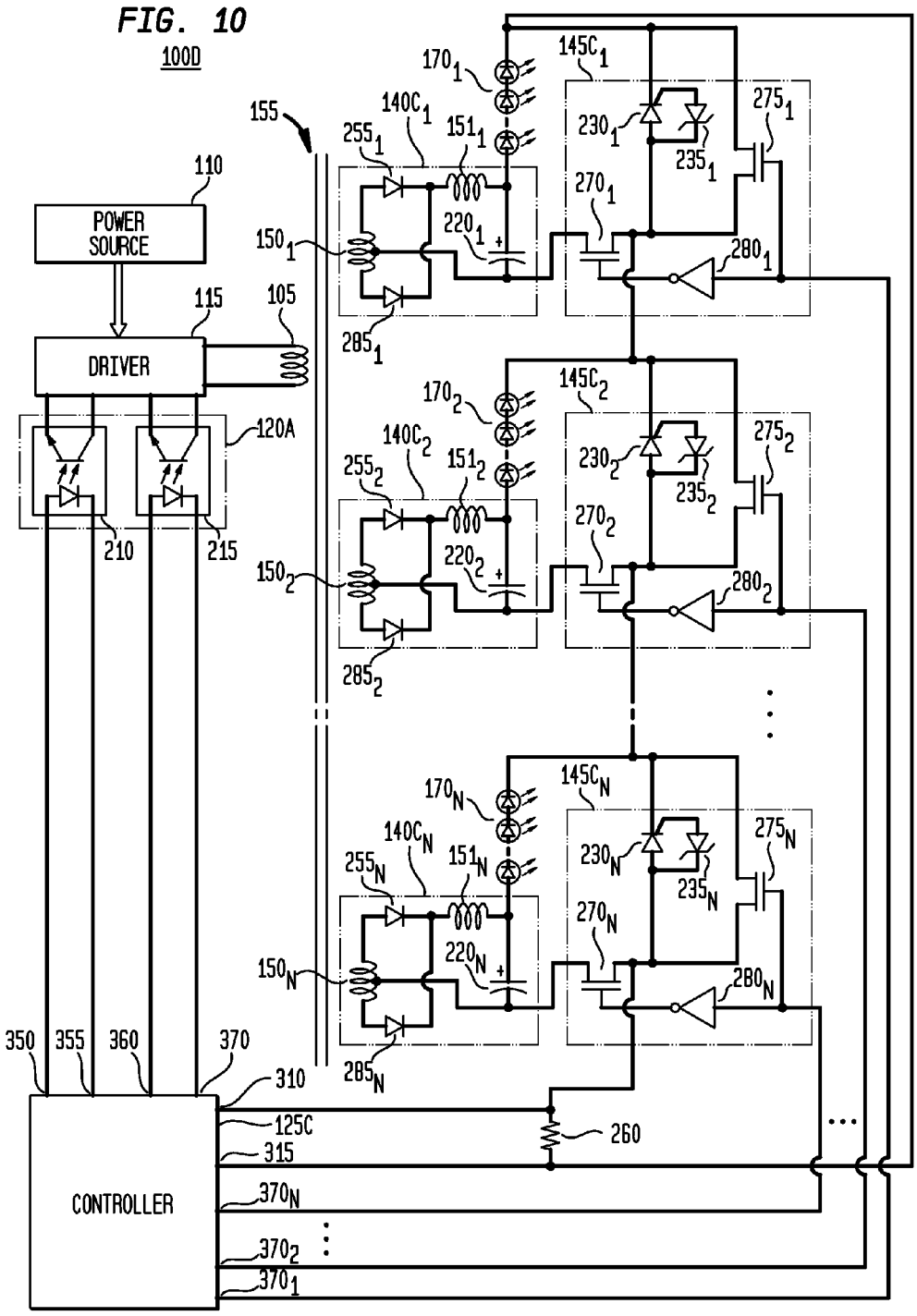
FIG. 10 is a block and circuit diagram illustrating a fifth exemplary system and fifth exemplary apparatus in accordance with the teachings of the present disclosure.

FIG. 10 is a block and circuit diagram illustrating a fifth exemplary system 100D and fifth exemplary apparatus in accordance with the teachings of the present invention. As illustrated, the fifth exemplary system 100D differs from the exemplary systems previously discussed insofar as power modules 140C utilize a half-bridge configuration and in the addition of first switches 275, second switches 270, and inverters 280 to bypass circuits 145C. Bypass circuits 145C$_1$, 145C$_2$, through 145C$_N$ comprise SCRs 230$_1$, 230$_2$, through 230$_N$, zener diodes 235$_1$, 235$_2$, through 235$_N$, first switches 275$_1$, 275$_2$, through 275$_N$, second switches 270$_1$, 270$_2$, through 270$_N$, and inverters 280$_1$, 280$_2$, through 280$_N$, respectively. Power modules 140C$_1$, 140C$_2$, through 140C$_N$ comprise center-tapped transformer secondaries 150$_1$, 150$_2$, through 150$_N$, first diodes 255$_1$, 255$_2$, through 255$_N$, second diodes 285$_1$, 285$_2$, through 285$_N$, inductors 151$_1$, 151$_2$, through 151$_N$, and capacitors 220$_1$, 220$_2$, through 220$_N$, respectively. (An apparatus portion of system 100D is not separately illustrated, but may be considered to comprise driver 115, isolator 120A, controller 125C, resistor 260 (as a sensor), power modules 140C, transformer 155, and bypass circuits 145C. In this exemplary embodiment, a primary module is not separately illustrated, but may be considered to comprise driver 115 and transformer primary 105 (of transformer 155). Also in this exemplary embodiment, a secondary module is not separately illustrated, but may be considered to comprise a corresponding power module 140C and, as an option, a corresponding bypass circuit 145C. Each power module 140C comprises a transformer secondary 150 (of transformer 155) and other circuitry as illustrated. The optional isolator 120A also may be considered to be contained within the primary module.) FIG. 10 provides an example of the power modules 140C (of a corresponding secondary module) and transformer primary 105 (of a primary module) having a half-bridge configuration.

The system and apparatus illustrated in FIG. 10, as discussed in greater detail below, is particularly useful for dimming applications in LED lighting, for example, along with control over the emitted spectrum of such lighting. In addition, in the event the system 100D and corresponding apparatus may be utilized in dynamic or addressable displays, control is provided for individual on, off, and emission scaling (e.g., brightness scaling) for pixel addressability (e.g., when an LED 170 or string of LEDs 170 forms a pixel for an addressable display).

Operation of bypass circuits 145C and power modules 140C in an exemplary embodiment will be described utilizing, as an example, a first bypass circuit 145C$_1$, a first power module 140C$_1$, and a first LED string 170$_1$. Operation of other bypass circuits 145C$_2$ through 145C$_N$ and power modules 140C$_2$ through 140C$_N$ is similar. Secondary 150$_1$, first diode 255$_1$ and second diode 285$_1$ form a full-wave, half-bridge rectifier and provide power to inductor 151$_1$ and capacitor 220$_1$, which in turn provide power to LED string 170$_1$. SCR 230$_1$ and zener diode 235$_1$ provide a bypass function similar to that illustrated in FIG. 4. A first switch 275$_1$, with its source and drain coupled in parallel with the anode and cathode of SCR 230$_1$, provides an additional bypass function in response to first output signal (on output 370$_1$) from controller 125C to the gate of first switch 275$_1$. In an exemplary embodiment, the gate of a second switch 270$_1$ receives a complement of the first output signal via inverter 280$_1$ so that the second switch 270$_1$ turns off at generally or substantially the same time as first switch 275$_1$ turns on and second switch 270$_1$ turns on at generally or substantially the same time as first switch 275$_1$ turns off. (It is to be understood that there may be some switching delay such as due to component response times and the intervening inverter 280.) In an alternative embodiment, inverter 280$_1$ may be replaced with a dual output buffer (not separately illustrated) with a first output such as a non-inverting output and a second output such as an inverting output, wherein the first output is coupled to the gate of the first switch 275$_1$ and the second output is coupled to the gate of the second switch 270$_1$. The buffer may be part of or separate from controller 125C. In the exemplary embodiment illustrated in FIG. 10, second switch 270$_1$ is shown in a low-side location. Alternative positions are possible, such as high-side locations, such as (not separately illustrated) in series with LEDs 170.

With first switch 275$_1$ in an off state and second switch 270$_1$ in an on state, power module 140C$_1$ provides power to LED string 170$_1$. With first switch 275$_1$ in an on state and second switch 270$_1$ in an off state, power module 140C$_1$ is disconnected from LED string $170_1$ and bypass circuit $145C_1$ shunts current around power module $140C_1$ and LED string $170_1$. Controller 125C may thus utilize first output signal $370_1$ to turn LED string $170_1$ off and on. Similarly, controller 125C may turn LED strings $170_2$ through $170_N$ on and off independently via additional output signals on outputs $370_2$ through $370_N$, respectively. Such a capability may be utilized, for example, for controlling LED displays or lighting where it may be desired to turn individual LEDs or channels of LEDs on and off, entirely, periodically, or otherwise selectably. In an exemplary embodiment, controller 125C may also effectively reduce or increase the average power level provided to individual LED strings 170, such as for setting apparent brightness (as perceived by the human eye) to a selected or predetermined level (i.e., dimming), utilizing pulse wave modulation (PWM). By rapidly (relative to the response time of the human eye) turning individual LED channels 170 off and on and by adjusting the ratio of "on" time $t_{ON}$ to "off" time $t_{OFF}$, the LED channels 170 may appear to independently dim or brighten in response to corresponding output signals on outputs $370_1$ through $370_N$ from controller 125C. In addition, controller 125C may also increase or decrease the brightness, such as average brightness, of LED strings 170 as a group by providing signals to driver 115 adapted to cause driver 115 to increase or decrease the amount of power or current provided to primary 105.

In another exemplary embodiment, a first load comprises at least one first LED $170_1$ having a first emission spectrum (such as an emission spectrum in the red, green, blue, white, yellow, amber, or other visible wavelengths), and a second load comprises at least one LED $170_2$ having a second emission spectrum. For example, a first LED may provide emission in the red visible spectrum, a second LED may provide emission in the green visible spectrum, and a third LED may provide emission in the blue visible spectrum, and so on. In such an exemplary embodiment, the controller 125C may be further adapted to regulate an output spectrum by regulating the first bypass circuit, or the second bypass circuit, or a third bypass circuit, such as by dimming or bypassing a corresponding LED string, to modify the overall emitted light spectrum, such as to increase or decrease corresponding portions of red, green, or blue emitted light, for example. This type of control may be utilized to provide any type of architectural or other ambient lighting effect.

Figure 11:
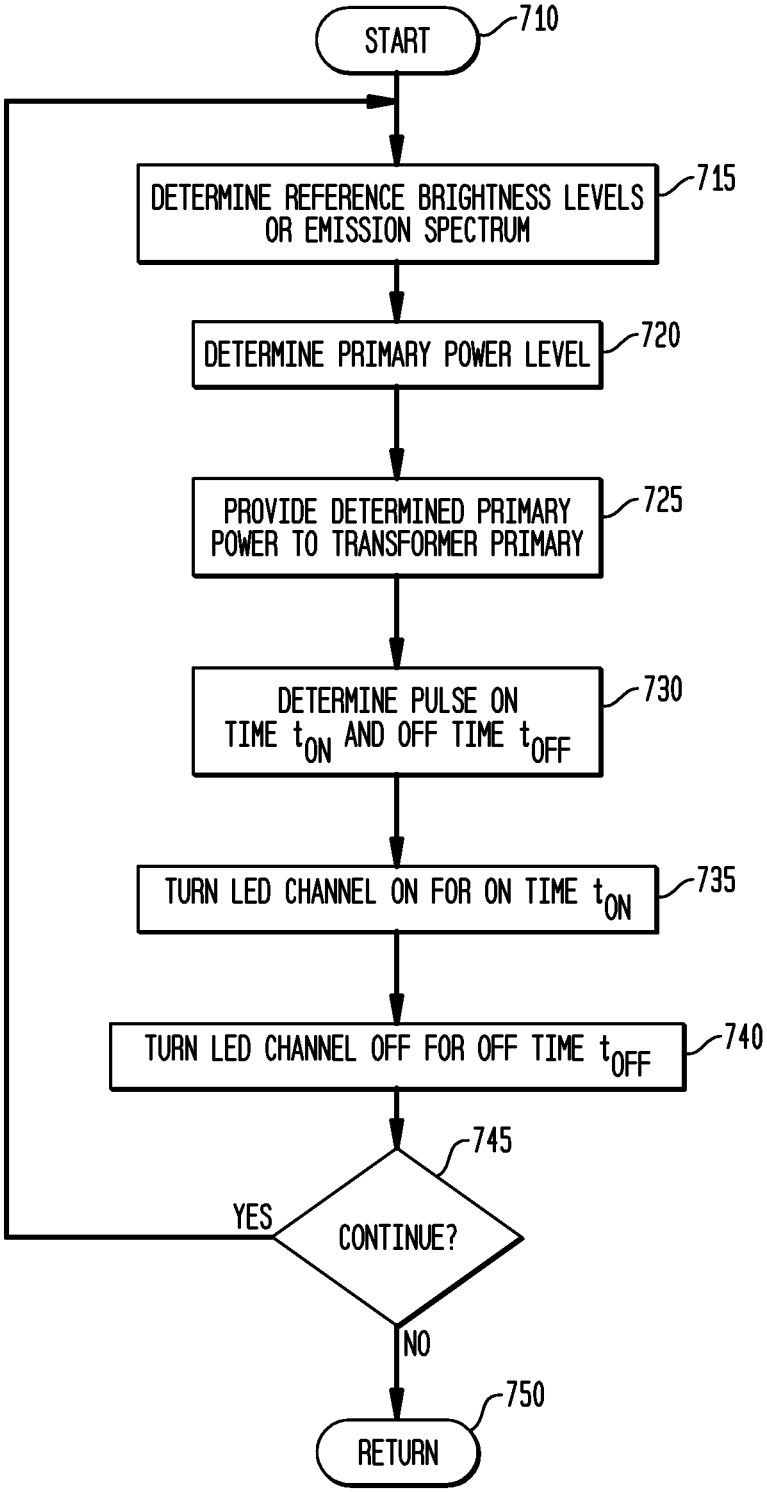
FIG. 11 is a flow diagram illustrating a method of adjusting LED brightness or emission levels in accordance with the teachings of the present disclosure.

FIG. 11 is a flow diagram illustrating a method of adjusting LED brightness or emission levels, including turning or pulsing on or off strings of LEDs 170, independently or non-independently, in accordance with the teachings of the present invention. This method may include determining a pulse width for the duration of switching on (or on-time duration) for each LED channel $170_1$, $170_2$, through $170_N$ and/or an overall power level or emission spectrum for a plurality of LED channels 170. These types of parameters may also be predetermined or stored in any associated memory of controller 125C. Beginning with start step 710, controller 125C determines (or obtains from a memory circuit) one or more reference levels, corresponding to desired (e.g., selected or predetermined) brightness or emission spectrum of LED channels 170, in step 715. Reference levels may, for example, be read from a memory or from a processor or other device and may be predetermined or dynamically determined. In an exemplary embodiment, reference levels represent a selected or predetermined brightness for each LED channel $170_1$, $170_2$, through $170_N$. In another exemplary embodiment, reference levels may be varied dynamically during operation (e.g., by the user) and represent a user-selected or predetermined brightness for each LED channel $170_1$, $170_2$, through $170_N$. In another exemplary embodiment, reference levels may be varied dynamically during operation (e.g., by the user) and represent a user-selected or predetermined color brightness for each LED channel $170_1$, $170_2$, through $170_N$, where the various LED channels have different emission spectra, such as red, green, blue, amber, white, etc.

In step 720, a primary power or current level is determined, for example by controller 125C. The primary power or current level may, for example, be determined as a function of a general power setting such as average desired brightness, emission spectra (desired output color), which also may be averaged over LED channels 170 or total selected or predetermined output power for power modules $140C_1$, $140C_2$, through $140C_N$. In step 725, the determined primary power or current level is utilized to provide power to transformer primary 105.

In step 730, a pulse width or a pulse "on" time $t_{ON}$ and "off" time $t_{OFF}$ are determined for each channel. The value of $t_{ON}$ and $t_{OFF}$ may be different for each channel. In an exemplary embodiment, $t_{ON}$ may be substantially proportional to the selected or predetermined brightness of the corresponding channel. The "off" time $t_{OFF}$ may be determined utilizing any of various methods such as determining $t_{OFF}$ to be substantially proportional to a predetermined pulse interval (i.e. the period of time between the start of two adjacent pulses) minus $t_{ON}$. A pulse interval may, for example, be predetermined such that the action of LEDs 170 turning on and off is substantially imperceptible to the human eye.

The perceived brightness of each channel may be substantially proportional to both the corresponding pulse width determined in step 730 for the corresponding channel and the primary power or current level determined in step 720. In an exemplary embodiment, each LED channel is turned on in step 735 for an "on" time $t_{ON}$ and turned off in step 740 for an "off" time $t_{OFF}$. When the method is to continue, step 745, the method returns to step 715, and otherwise may end, return step 750.

Figure 12:
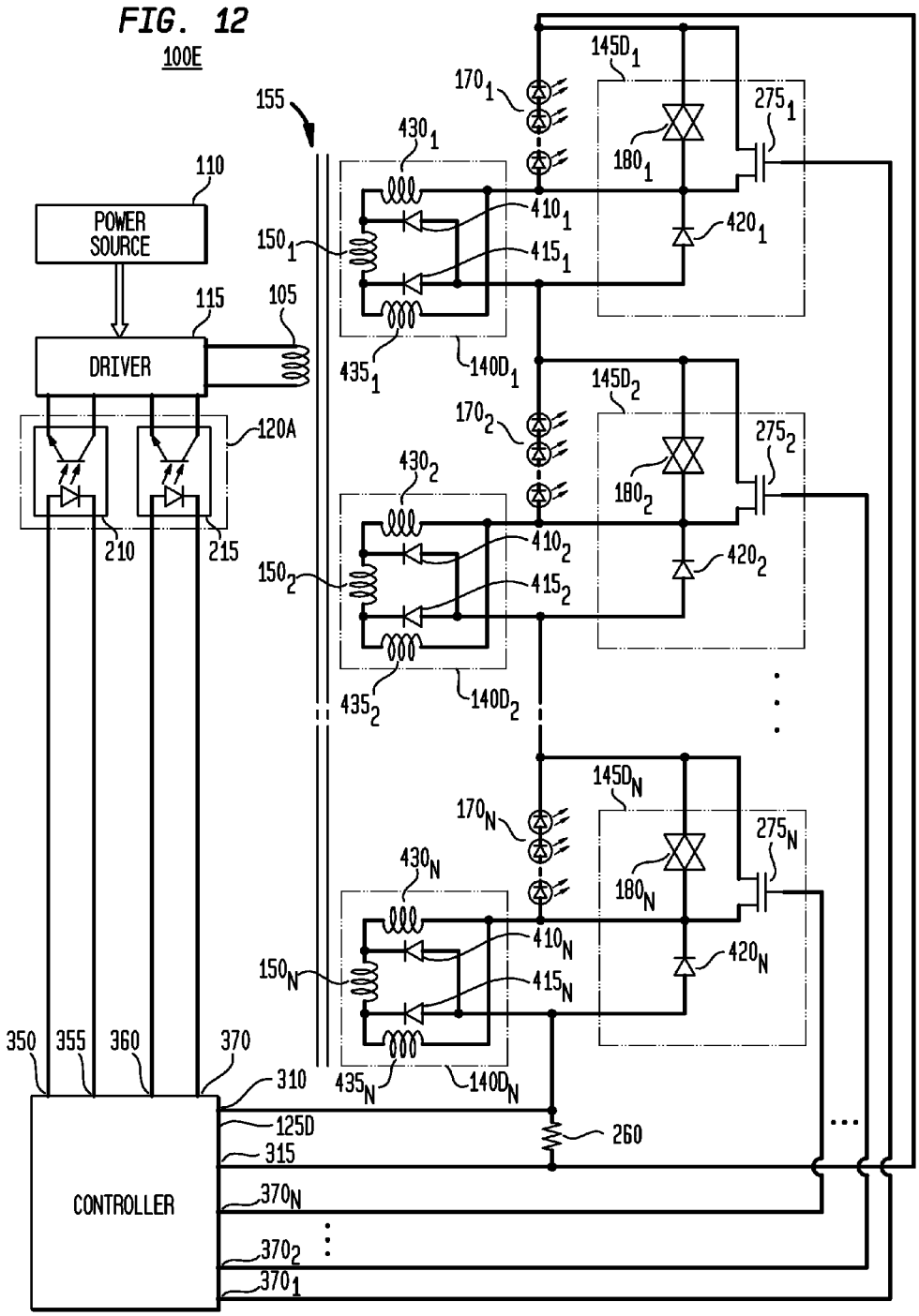
FIG. 12 is a block and circuit diagram illustrating a sixth exemplary system and sixth exemplary apparatus in accordance with the teachings of the present disclosure.

FIG. 12 is a block and circuit diagram illustrating a sixth exemplary system 100E and sixth exemplary apparatus in accordance with the teachings of the present invention. As illustrated, the sixth exemplary system 100E differs from the previously discussed systems insofar as power modules 140D utilize a current doubling circuit configuration and in changes to the bypass circuits, denoted in FIG. 12 as bypass circuits $145D_1$, $145D_2$, through $145D_N$. (An apparatus portion of system 100E is not separately illustrated, but may be considered to comprise driver 115, isolator 120A, controller 125D, resistor 260 (as a sensor), power modules 140D, transformer 155, and bypass circuits 145D. In this exemplary embodiment, a primary module is not separately illustrated, but may be considered to comprise driver 115 and transformer primary 105 (of transformer 155). Also in this exemplary embodiment, a secondary module is not separately illustrated, but may be considered to comprise a corresponding power module 140D and, as an option, a corresponding bypass circuit 145D. Each power module 140D comprises a transformer secondary 150 (of transformer 155) and other circuitry as illustrated. The optional isolator 120A also may be considered to be contained within the primary module.) FIG. 12 provides an example of the power modules 140D (of a corresponding secondary module) and transformer primary 105 (of a primary module) having a current doubler configuration.

Power modules $140D_1$, $140D_2$, through $140D_N$ comprise transformer secondaries $150_1$, $150_2$, through $150_N$, first diodes $410_1$, $410_2$, through $410_N$, second diodes $415_1$, $415_2$, through $415_N$, first inductors $430_1$, $430_2$, through $430_N$, and second inductors $435_1$, $435_2$, through $435_N$, respectively. Bypass circuits $145D_1$, $145D_2$, through $145D_N$ comprise third diodes $420_1$, $420_2$, through $420_N$, diacs $180_1$, $180_2$, through $180_N$, and switches $275_1$, $275_2$, through $275_N$, respectively.

Operation of bypass circuits 145D and power modules 140D in an exemplary embodiment is described utilizing, as an example, a first bypass circuit $145D_1$, a first power module $140D_1$, and a first LED string $170_1$. Operation of other bypass circuits $145D_2$ through $145D_N$ and power modules $140D_2$ through $140D_N$ is similar. Secondary $150_1$ provides power to a rectifier circuit, configured as a current doubler and comprising first diode $410_1$, second diode $415_1$, first inductor $430_1$, and second inductor $435_1$. The first power module $140D_1$ provides power to LED string $170_1$.

Bypass circuit $145D_1$ comprises third diode $420_1$, diac $180_1$, and switch $275_1$. Third diode $420_1$ provides current bypass for power module $140D_1$, while diac $180_1$ and switch $275_1$ provide current bypass for LED string $170_1$. If LED string $170_1$ becomes an open or relatively high impedance circuit, a voltage level across diac $180_1$ may increase to a value greater than or substantially equal to a predetermined threshold, causing diac $180_1$ to trip and bypass (i.e., shunt current around) the LED string $170_1$. Third diode $420_1$ is coupled in parallel with power module $140D_1$ and may shunt current around power module $140D_1$ to LED string $170_1$ and to other channels in the event of a fault in power module $140D_1$. That LED string $170_1$ may continue to receive power despite a fault in the corresponding power module $140D_1$ is a significant advantage of exemplary embodiments of the present invention over prior art power converters. Third diode $420_1$ may be considered optional because, in various exemplary embodiments, other components in the rectifier circuit may shunt power past power module $140D_1$ in the event of a fault in power module $140D_1$. For example, if secondary $150_1$ becomes an open circuit, diode $410_1$ and inductor $430_1$ may provide a current path through power module $140D_1$. Third diode $420_1$, placed across a power module, may also be utilized in conjunction with alternate embodiments such as those illustrated in FIG. 2, FIG. 3, FIG. 4, FIG. 8, and FIG. 10 to bypass power module $140D_1$ (or variations) in the event of a power module fault.

Switch $275_1$, placed in parallel with LED string $170_1$, may serve as a current shunt to substantially stop current flow through LED string $170_1$ and set LED string $170_1$ to an "off" state in response to a control signal on output $370_1$ of controller 125D, as previously discussed. Similarly, controller 125D may independently control LED strings $170_2$ through $170_N$ by providing output signals (on outputs $370_2$ through $370_N$) to the respective gates of switches $275_2$ through $275_N$. Such control may be separate and independent or may be coordinated, such as for brightness control or architectural lighting effects. As with the exemplary embodiments illustrated in FIG. 10 and FIG. 11, controller 125D may turn LED strings $170_1$, $170_2$, through $170_N$ on and off independently or may dim or brighten individual channels, for example by utilizing PWD methods such as the method described in FIG. 11.

Figure 13:
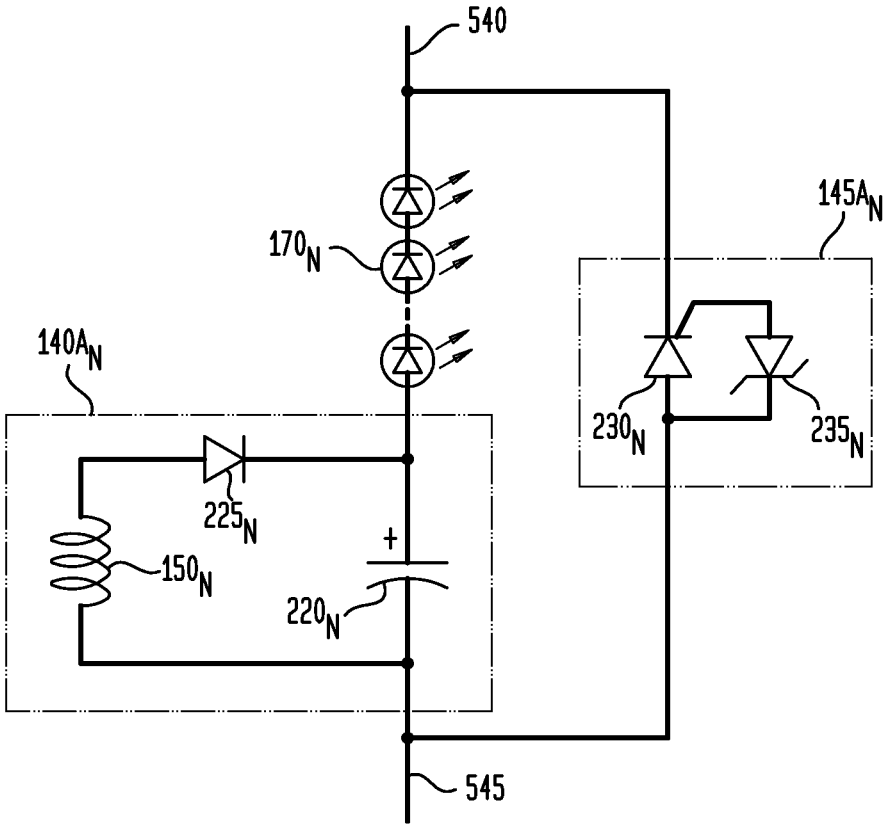
FIG. 13 is a circuit diagram illustrating an example of a secondary module with bypass circuitry and coupled to an LED channel in accordance with the teachings of the present disclosure.

FIG. 13 is a circuit diagram illustrating an example of a secondary module with bypass circuitry and coupled to an LED channel in accordance with the teachings of the present invention, comprising a power module $140A_N$, a bypass circuit $145A_N$, and an LED string $170_N$. Components illustrated in FIG. 13 correspond to components associated with an $N^{th}$ channel as illustrated in FIG. 4. The topology further comprises a first terminal 545, which may be coupled to an adjacent LED channel and associated circuitry, and a second terminal 540, which may be coupled to an adjacent, $N-1^{th}$ secondary module and associated circuitry. Power module $140A_N$ comprises a transformer secondary $150_N$, diode $225_N$, and capacitor $220_N$. Bypass circuit $145A_N$ comprises a switch, illustrated as an SCR $230_N$, and a sensor, illustrated as zener diode $235_N$. Secondary $150_N$ provides power through diode $225_N$ to capacitor $220_N$. Diode $225_N$ and capacitor $220_N$ provide power to LED string $170_N$. If voltage across bypass circuit $145A_N$ increases to a point greater than or substantially equal to a predetermined threshold, zener diode $235_N$ conducts, turning on SCR $230_N$. With SCR $230_N$ in an "on" state, current is bypassed around power module $140A_N$ and LED string $170_N$. In particular, SCR $230_N$ shunts current from an associated secondary module and LED channel via first terminal 545, to an adjacent secondary module and LED channel via second terminal 540.

The controller 125 (including variations 125A, 125B, 125C, and 125D) may be any type of controller or processor, and may be embodied as any type of digital logic or analog circuitry or combination thereof or any other circuitry adapted to perform the functionality discussed herein. The controller (including variations) may have other or additional outputs and inputs to those described and illustrated herein, and all such variations are considered equivalent and within the scope of the present invention. Similarly, not all inputs and outputs may be utilized for a given embodiment of the present invention. As the term controller, processor or control logic block is used herein, a controller or processor or control logic block may include use of a single integrated circuit ("IC"), or may include use of a plurality of integrated circuits or other components connected, arranged or grouped together, such as controllers, microprocessors, digital signal processors ("DSPs"), parallel processors, multiple core processors, custom ICs, application specific integrated circuits ("ASICs"), field programmable gate arrays ("FPGAs"), adaptive computing ICs, associated memory (such as RAM, DRAM and ROM), discrete components, and other ICs and components. As a consequence, as used herein, the term controller, processor or control logic block should be understood to equivalently mean and include a single IC, or arrangement of custom ICs, ASICs, processors, microprocessors, controllers, FPGAs, adaptive computing ICs, or some other grouping of integrated circuits or electronic components which perform the functions discussed herein, with any associated memory, such as microprocessor memory or additional RAM, DRAM, SDRAM, SRAM, MRAM, ROM, PROM, FLASH, EPROM, or $E^2$PROM. A controller or processor (such as controller 125, 125A, 125B, 125C, and 125D), with its associated memory, may be adapted or configured (via programming, FPGA interconnection, or hard-wiring) to perform the methodology of the invention, as discussed above and below. For example, the methodology may be programmed and stored, in a controller 125 and other equivalent components, as a set of program instructions or other code (or equivalent configuration or other program) for subsequent execution when the controller or processor is operative (i.e., powered on and functioning). Equivalently, the controller may be implemented in whole or part as FPGAs, digital logic such as registers and gates, custom ICs and/or ASICs, the FPGAs, digital logic such as registers and gates, custom ICs or ASICs, also may be designed, configured and/or hard-wired to implement the methodology of the invention. For example, the controller or processor may be implemented as an arrangement of controllers, microcontrollers, microprocessors, state machines, DSPs and/or ASICs, which are respectively programmed, designed, adapted or configured to implement the methodology of the invention.

The controller 125 (and variations) may comprise memory, which may include a data repository (or database) and may be embodied in any number of forms, including within any computer or other machine-readable data storage medium, memory device or other storage or communication device for storage or communication of information, currently known or which becomes available in the future, including, but not limited to, a memory integrated circuit ("IC"), or memory portion of an integrated circuit (such as the resident memory within a controller or processor IC), whether volatile or non-volatile, whether removable or non-removable, including without limitation RAM, FLASH, DRAM, SDRAM, SRAM, MRAM, FeRAM, ROM, EPROM, or $E^2$PROM, or any other form of memory device, such as a magnetic hard drive, an optical drive, a magnetic disk or tape drive, a hard disk drive, other machine-readable storage or memory media such as a floppy disk, a CDROM, a CD-RW, digital versatile disk (DVD) or other optical memory, or any other type of memory, storage medium, or data storage apparatus or circuit, which is known or which becomes known, depending upon the selected embodiment. In addition, such computer readable media includes any form of communication media, which embodies computer readable instructions, data structures, program modules or other data in a data signal or modulated signal. The memory may be adapted to store various look up tables, parameters, coefficients, other information and data, programs or instructions (of the software of the present invention), and other types of tables such as database tables.

As indicated above, the controller may be programmed, using software and data structures, for example, to perform the methodology of the present disclosure. As a consequence, systems and methods may be embodied as software, which provides such programming or other instructions, such as a set of instructions and/or metadata embodied within a computer readable medium, discussed above. In addition, metadata may also be utilized to define the various data structures of a look up table or a database. Such software may be in the form of source or object code, by way of example and without limitation. Source code further may be compiled into some form of instructions or object code (including assembly language instructions or configuration information). The software, source code or metadata may be embodied as any type of code, such as C, C++, C#, SystemC, LISA, XML, Java, ECMAScript, JScript, Brew, SQL and its variations (e.g., SQL 99 or proprietary versions of SQL), DB2, Oracle, or any other type of programming language which performs the functionality discussed herein, including various hardware definition or hardware modeling languages (e.g., Verilog, VHDL, RTL) and resulting database files (e.g., GDSII). As a consequence, a "construct", "program construct", "software construct" or "software", as used equivalently herein, means and refers to any programming language, of any kind, with any syntax or signatures, which provides or can be interpreted to provide the associated functionality or methodology specified (when instantiated or loaded into a processor or computer and executed, including the controller 125, for example).

The software, metadata, or other source code and any resulting bit file (object code, database, or look up table) may be embodied within any tangible storage medium, such as any of the computer or other machine-readable data storage media, as computer-readable instructions, data structures, program modules or other data, such as discussed above, e.g., a floppy disk, a CDROM, a CD-RW, a DVD, a magnetic hard drive, an optical drive, or any other type of data storage apparatus or medium, as mentioned above.

In some exemplary embodiments, control circuitry may be implemented using digital circuitry such as logic gates, memory registers, a digital processor such as a microprocessor or digital signal processor, I/O devices, memory, analog-to-digital converters, digital-to-analog converters, FPGAs, etc. In other exemplary embodiments, this control circuitry may be implemented in analog circuitry such as amplifiers, resistors, integrators, multipliers, error amplifiers, operational amplifiers, etc. For example, one or more parameters stored in digital memory may, in an analog implementation, be encoded as the value of a resistor or capacitor, the voltage of a zener diode or resistive voltage divider, or otherwise designed into a circuit. It is to be understood that embodiments illustrated as analog circuitry may alternatively be implemented with digital circuitry or with a mixture of analog and digital circuitry and that embodiments illustrated as digital circuitry may alternatively be implemented with analog circuitry or with a mixture of analog and digital circuitry within the scope of the present disclosure.

Controller 125 executes methods of control as described in the exemplary embodiments. Methods of implementing, in software and/or logic, a digital form of the embodiments shown herein is well known by those skilled in the art. The controller 125 may comprise any type of digital or sequential logic for executing the methodologies and performing selected operations as discussed above and as further described below. For example, the controller 125 may be implemented as one or more finite state machines, various comparators, integrators, operational amplifiers, digital logic blocks, configurable logic blocks, or may be implemented to utilize an instruction set, and so on, as described herein.

Switches illustrated and described herein, such as fuses 190 and switches shown in the Figures, are illustrated as SCRs, diacs, MOSFETs, diodes, fuses, etc., and may be implemented as any type of power switch, in addition to those illustrated, including without limitation a thyristor such as a diac, sidac, SCR, triac, or quadrac, a bipolar junction transistor, an insulated-gate bipolar transistor, a N-channel or P-channel MOSFET, a relay or other mechanical switch, a vacuum tube, various enhancement or depletion mode FETs, fuses, diodes, etc. A plurality of power switches may be utilized in the circuitry.

Numerous advantages of the exemplary embodiments, for providing power to loads such as LEDs, are readily apparent. The exemplary embodiments provide power conversion for multiple channels of LEDs at comparatively low voltage levels. The exemplary embodiments provide an overall reduction in size, weight, and cost of the power converter by sharing components across channels. The exemplary embodiments provide increased reliability by providing continued operation of one or more channels in the event of faults. The exemplary embodiments further provide stable output power levels and compensate for factors such as temperature, component aging, and manufacturing tolerances. Exemplary embodiments provide independent control over individual channels such as dimming, emission spectra, and turning channels on or off.

Although various methods, systems and apparatuses have been described with respect to specific embodiments thereof, these embodiments are merely illustrative and should not be considered restrictive in any manner. In the description herein, numerous specific details are provided, such as examples of electronic components, electronic and structural connections, materials, and structural variations, to provide a thorough understanding of embodiments disclosed. One skilled in the relevant art will recognize, however, that an embodiment can be practiced without one or more of the specific details, or with other apparatus, systems, assemblies, components, materials, parts, etc. In other instances, well-known structures, materials, or operations are not specifically shown or described in detail to avoid obscuring aspects of embodiments disclosed herein. In addition, the various Figures are not drawn to scale and should not be regarded as limiting.

Reference throughout this specification to "one embodiment," "an embodiment," or a specific "embodiment" means that a particular feature, structure, or characteristic described in connection with the embodiment is included in at least one embodiment and not necessarily in all embodiments, and further, are not necessarily referring to the same embodiment. Furthermore, the particular features, structures, or characteristics of any specific embodiment may be combined in any suitable manner and in any suitable combination with one or more other embodiments, including the use of selected features without corresponding use of other features. In addition, many modifications may be made to adapt a particular application, situation or material to the essential scope and spirit of the claimed subject matter. It is to be understood that other variations and modifications of the embodiments described and illustrated herein are possible in light of the teachings herein and are to be considered part of the spirit and scope of the appended claims.

It will also be appreciated that one or more of the elements depicted in the Figures can be implemented in a more separate or integrated manner, or even removed or rendered inoperable in certain cases, as may be useful in accordance with a particular application. Integrally formed combinations of components are also within the scope of the claimed subject matter, particularly for embodiments in which a separation or combination of discrete components is unclear or indiscernible. In addition, use of the term "coupled" herein, including in its various forms such as "coupling" or "couplable," means and includes any direct or indirect electrical, structural or magnetic coupling, connection or attachment, or adaptation or capability for such a direct or indirect electrical, structural or magnetic coupling, connection or attachment, including integrally formed components and components which are coupled via or through another component.

As used herein for purposes of the claimed subject matter, the term "LED" and its plural form "LEDs" should be understood to include any electroluminescent diode or other type of carrier injection- or junction-based system which is capable of generating radiation in response to an electrical signal, including without limitation, various semiconductor- or carbon-based structures which emit light in response to a current or voltage, light emitting polymers, organic LEDs, and so on, including within the visible spectrum, or other spectra such as ultraviolet or infrared, of any bandwidth, or of any color or color temperature.

Channels of LEDs may have the same or different numbers of LEDs. Channels of LEDs may be illustrated and described herein utilizing LED strings as exemplary embodiments, however it is to be understood that LED channels may comprise one or more LEDs in innumerable configurations such as a plurality of strings in series or parallel, arrays of LEDs, LEDs of various types and colors, and LEDs combined with other components such as diodes, resistors, fuses, positive temperature coefficient (PTC) fuses, sensors such as optical sensors or current sensors, switches, etc., any and all of which are considered equivalent and within the scope of the present disclosure. Although, in an exemplary embodiment, the power converter drives one or more LEDs, the converter may also be suitable for driving other linear and nonlinear loads such as computer or telephone equipment, lighting systems, radio transmitters or receivers, telephones, computer displays, motors, heaters, etc. Where reference is made herein to a load or group of LEDs, it is to be understood that a load (such as LEDs) may comprise a plurality of loads.

In the foregoing description and in the Figures, sense resistors are shown in exemplary configurations and locations; however, those skilled in the art will recognize that other types and configurations of sensors may also be used and that sensors may be placed in other locations. Alternate sensor configurations and placements are within the scope of the present disclosure.

It is to be understood in discussing fault modes that the terms "short circuit" and "open circuit" are used herein as examples of types of component failures. The term "short circuit" may include partial short circuit conditions where impedance or voltage drops to a level lower than normal (i.e., absent faults) operational level, such as below a predetermined threshold. The term "open circuit" may include partial open circuit conditions where impedance or voltage increases to a level higher than during normal operation, such as above another predetermined threshold.

As used herein, the term "DC" denotes both fluctuating DC (such as is obtained from rectified AC), chopped DC, and constant voltage DC, such as is obtained from a battery, voltage regulator, or power filtered with a capacitor. As used herein, the term "AC" denotes any form of alternating current, such as single phase or multiphase, with any waveform (sinusoidal, sine squared, rectified sinusoidal, square, rectangular, triangular, sawtooth, irregular, etc.), and with any DC offset and may include any variation such as chopped or forward- or reverse-phase modulated alternating current, such as from a dimmer switch.

In the foregoing description of illustrative embodiments and in attached figures where diodes are shown, it is to be understood that synchronous diodes or synchronous rectifiers (for example relays or MOSFETs or other transistors switched off and on by a control signal) or other types of diodes may be used in place of standard diodes within the scope of the present disclosure. Exemplary embodiments presented here typically generate positive voltages with respect to ground potential; however, the teachings of the present disclosure apply also to power converters that generate positive and/or negative voltages, where mixed or complementary topologies may be constructed, such as by reversing the polarity of semiconductors and other polarized components or by swapping positive and negative terminals on power modules, bypass circuits, loads, etc.

Furthermore, any signal arrows in the drawings/Figures should be considered only exemplary, and not limiting, unless otherwise specifically noted. Combinations of components of steps will also be considered within the scope of the present disclosure, particularly where the ability to separate or combine is clear or foreseeable. The disjunctive term "or," as used herein and throughout the claims that follow, is generally intended to mean "and/or," having both conjunctive and disjunctive meanings (and is not confined to an "exclusive or" meaning), unless otherwise indicated. As used in the description herein and throughout the claims that follow, "a," "an," and "the" include plural references unless the context clearly dictates otherwise. Also as used in the description herein and throughout the claims that follow, the meaning of "in" includes "in" and "on" unless the context clearly dictates otherwise.

The foregoing description of illustrated embodiments, including what is described in the summary or in the abstract, is not intended to be exhaustive or to limit the claimed subject matter to the precise forms disclosed herein. From the foregoing, it will be observed that numerous variations, modifications and substitutions are intended and may be effected without departing from the spirit and scope of the novel concepts described here. It is to be understood that no limitation with respect to the specific methods and apparatus illustrated herein is intended or should be inferred. It is, of course, intended to cover by the appended claims all such modifications as fall within the scope of the claims.

The invention claimed is:

1. An apparatus comprising:

a primary module including a transformer having a transformer primary;

a first secondary module electrically couplable to a first load that includes at least one light emitting diode (LED), wherein the first secondary module includes a first transformer secondary magnetically coupled to the transformer primary; and a second secondary module electrically couplable to a second load that includes at least one LED, wherein the second secondary module includes a second transformer secondary magnetically coupled to the transformer primary, and wherein the second secondary module is electrically couplable selectively through the at least one LED of the first load and the at least one LED of the second load to the first secondary module such that direct current flows in sequential order from the second secondary module to the first secondary module and back to the second secondary module.

2. The apparatus of claim 1, wherein the first secondary module is configured to have a first voltage polarity, and wherein the first load is configured to have a second voltage polarity opposite the first voltage polarity.

3. The apparatus of claim 2, wherein a resultant voltage of the first voltage polarity combined with the voltage of the second voltage polarity is substantially less than a magnitude of the first voltage polarity or the second voltage polarity.

4. The apparatus of claim 2, wherein the voltages of the first voltage polarity and the second voltage polarity substantially offset each other to provide a comparatively low resultant voltage.

5. The apparatus of claim 2, wherein the second secondary module is configured to have a third voltage polarity, and wherein the second load is configured to have a fourth voltage polarity opposite the third voltage polarity.

6. The apparatus of claim 5, wherein a resultant voltage of a combination of the first voltage polarity, the second voltage polarity, the third voltage polarity, and the fourth voltage polarity is substantially less than a magnitude of the first voltage polarity, the second voltage polarity, the third voltage polarity, or the fourth voltage polarity.

7. The apparatus of claim 5, wherein the voltages of the first voltage polarity, the second voltage polarity, the third voltage polarity, and the fourth voltage polarity substantially offset one another to provide a comparatively low resultant voltage.

8. The apparatus of claim 1, wherein the first secondary module and the second secondary module are configured to have one of the following circuit topologies: a flyback configuration, a single-ended forward configuration, a half-bridge configuration, a full-bridge configuration, or a current-doubler configuration.

9. The apparatus of claim 1, wherein the first secondary module comprises a first rectifier and a first filter, wherein the first rectifier is coupled to the first transformer secondary, wherein the second secondary module comprises a second rectifier and a second filter, and wherein the second rectifier is coupled to the second transformer secondary.

10. An apparatus comprising:

a primary module including a transformer having a transformer primary;

a first secondary module electrically couplable to a first load that includes at least one light emitting diode (LED), wherein the first secondary module includes a first transformer secondary magnetically coupled to the transformer primary;

a second secondary module electrically couplable to a second load that includes at least one LED, wherein the second secondary module includes a second transformer secondary magnetically coupled to the transformer primary, and wherein the second secondary module is electrically couplable selectively through the at least one LED of the first load and the at least one LED of the second load to the first secondary module such that direct current flows in sequential order from the second secondary module to the first secondary module and back to the second secondary module;

a current sensor coupled to the first secondary module or the second secondary module, wherein the current sensor is configured to sense a current level; and a controller coupled to the current sensor and to the primary module, wherein the controller is configured to regulate a transformer primary current in response to the sensed current level.

11. The apparatus of claim 10, further comprising:

a first bypass circuit coupled to the first secondary module; and a second bypass circuit coupled to the second secondary module.

12. The apparatus of claim 11, wherein the first bypass circuit is configured to bypass the first secondary module and the first load in response to a detected fault.

13. The apparatus of claim 12, wherein the detected fault comprises an open circuit.

14. The apparatus of claim 11, wherein the controller is further configured to provide dimming of light output by regulating the first bypass circuit or the second bypass circuit.

15. The apparatus of claim 14, wherein the controller is configured to provide a pulse-width modulated signal to regulate the first bypass circuit or the second bypass circuit.

16. The apparatus of claim 14, wherein the controller is configured to place a corresponding switch into an on state or an off state to regulate the first bypass circuit or the second bypass circuit.

17. The apparatus of claim 11, wherein the controller is further configured to provide dimming of light output by regulating a transformer primary current.

18. The apparatus of claim 11, wherein a first light emitting diode of the first load has a first emission spectrum, wherein a second light emitting diode of the second load has a second emission spectrum, and wherein the controller is further configured to regulate an output spectrum by regulating the first bypass circuit or the second bypass circuit.

19. The apparatus of claim 10, wherein the controller is optically coupled to the primary module.

20. A lighting system comprising:

means for routing current from a first secondary module to a first light emitting diode coupled to the first secondary module to generate a first voltage across the first light emitting diode having an opposing polarity to a second voltage across the first secondary module;

means for routing current from the first light emitting diode to a second secondary module coupled to the first light emitting diode;

means for routing current from the second secondary module to a second light emitting diode coupled to the second secondary module to generate a third voltage across the second light emitting diode having an opposing polarity to a fourth voltage across the second secondary module; and means for routing current from the second light emitting diode to the first secondary module or to a third secondary module coupled to the second light emitting diode.

* * * * *